US005701945A

United States Patent [19]

McKibben et al.

[11] Patent Number: 5,701,945

[45] Date of Patent: Dec. 30, 1997

[54] AUTOMATED SPIN-CASTING SYSTEM

[75] Inventors: Kenneth D. McKibben, Defiance, Ohio; Alan P. Gould, Omer, Mich.; Thomas E. Wuepper, Alger, Mich.; Daniel D. Minor, Cadillac, Mich.; Mark T. Salgat, Pinconning, Mich.; David Marthaler, Au Gres, Mich.; Jackie M. Speaks, Cadillac, Mich.; Robert L. Macheske, Tawas City, Mich.; David Good, St. Catharines, Canada; Richard A. Gillette, West Branch, Mich.; Philip L. Bond, Richmond, Ind.; Donald C. Coyle, Richmond, Ind.; Darrell Rentfrow, Richmond, Ind.; Thomas O. Stiens, Richmond, Ind.; Larry M. Stevens, Greensburg, Ind.

[73] Assignee: CMI-Equipment & Engineering, Au Gres, Mich.

[21] Appl. No.: 524,780

[22] Filed: Sep. 7, 1995

[51] Int. Cl.[6] ..... B22D 47/00; B22D 5/02

[52] U.S. Cl. ..... 164/130; 164/167; 164/168; 164/325; 164/326

[58] Field of Search ..... 164/130, 18, 326, 164/327, 328, 129, 167, 168, 325

[56] References Cited

U.S. PATENT DOCUMENTS 3,703,921 11/1972 Hunter ..... 164/130

FOREIGN PATENT DOCUMENTS 57-103777 6/1982 Japan ..... 164/130

*Primary Examiner*—Joseph J. Hail, III

*Assistant Examiner*—L-H. Lin

*Attorney, Agent, or Firm*—Varnum, Riddering, Schmidt & Howlett LLP

[57] ABSTRACT

The invention relates to a system and method for the automated spin-casting production of molded articles. The system includes a casting turntable and a processing turntable which are rotatively mounted, immediately adjacent to one another. The casting turntable has several spin modules mounted thereon for rotatively supporting mold assemblies. Casting preparation and pouring mechanisms are mounted around the periphery of the casting turntable. The turntable indexes the mold assemblies and positions the assemblies for preparation, pouring and solidification of the cast products. The processing turntable receives the mold assemblies and solidified castings from the casting turntable. Multiple processing stations are mounted around the periphery of the processing table for the removal of the castings from the mold assemblies and preparation of the mold assemblies for additional casting operations. The mold assemblies are returned to the casting table from the processing table for additional casting processes.

25 Claims, 17 Drawing Sheets

AUTOMATED SPIN-CASTING SYSTEM

BACKGROUND OF THE INVENTION

1. Field of the Invention

This invention relates to the molding of cast products and, more particularly, to an automated system for spin-casting molded sleeves.

2. Description of the Related Art

Spin-casting processes have long been used to create molded products. One application of the spin-casting process is the molding of circular sleeves, particularly piston sleeves, for use in diesel engines and internal combustion engines. The spin-casting process is ideally suited for the creation of these sleeves because spinning of the mold during the solidification of the molten metal creates a tubular or sleeve-shaped casting having a substantially uniform internal diameter.

Known spin-casting systems and processes can be extremely labor intensive. For example, it is known to create a limited number of moldings at a single machine by a worker who pours molten metal into a rotating mold assembly, manually removes a mold insert from the mold assembly, manually removes the east metal sleeve from the mold assembly, manually cleans and reassembles the mold assembly for additional molding operations and then repeats the molding process.

There are numerous problems inherent in this manual molding system. Namely, this molding system is labor intensive and difficult to maintain uniformity between multiple operators on multiple machines. Another problem inherent in this system is the close proximity of the worker to the molding process. The high temperatures and machinery required for the casting operation can create an uncomfortable working environment. Still another problem inherent with this system is the inefficiency inherent in such a multi-step manual operation.

SUMMARY OF THE INVENTION

The automated molding system according to the invention overcomes the problems of the prior art by automating many of the steps of the spin-casting process creating greater processing controls over this system and dramatically increasing the parts produced per man hour of work.

In one aspect, the invention comprises a system for the automated production of castings in a plurality of mold assemblies. The system comprises a casting subsystem and a processing subsystem. The casting subsystem includes a casting table which is adapted to rotate about an axis of rotation. The table has a top surface and at least one mold assembly support module provided thereon. The mold assembly support modules are adapted to support at least one mold assembly. A pouring apparatus is provided adjacent the casting table and is adapted to provide molten casting material to the mold assembly. The processing subsystem comprises a processing table adapted to rotate about an axis of rotation. Preferably, the processing table is provided immediately adjacent to the casting table. The processing table has a top surface and at least one mold assembly support module provided thereon. The support module is adapted to support at least one of the mold assemblies. A casting removal apparatus is also provided adjacent the processing table and is adapted to remove a casting from the mold assembly. A transfer mechanism is provided adjacent to the processing and casting tables. The transfer mechanism is adapted to transfer the mold assemblies from the casting table to the processing table. In another embodiment, the transfer mechanism also returns the mold assemblies from the processing table to the casting table.

Preferably, the casting table includes multiple spin modules which are adapted to rotatably support the mold assemblies. Use of the spin modules allows for castings to be produced by a spin casting method. Preferably, the spin modules are rotated by a variable speed motor.

As noted above, a transfer mechanism is preferably used to transfer the mold assemblies to and from the casting and processing tables. Preferably, the transfer mechanism comprises a first support member provided adjacent the casting and processing tables. The first support member is adapted to transverse the space separating the casting and processing tables and is preferably supported above both the casting and processing tables. A second support member is supported by the first support member and is adapted to rotate relative to the first support member, casting table and processing table. A third support member is supported by the second support member and is adapted to raise and lower the mold assemblies relative to the processing and casting tables. With this structure, the mold assemblies can be transferred from the casting to the processing table by lifting, rotating, traversing and lowering the mold assemblies. Once the castings have been transferred to the processing table, they are now in position for additional processing steps such as cleaning and mold disassembly.

In another aspect, the invention relates to a method for the automated production of castings comprising the steps of providing a casting table rotatably supported on a support surface and at least one mold assembly support module provided on the casting table. A processing table is rotatably provided on the supporting surface and also has at least one mold assembly support module provided thereon. At least one mold assembly having a mold cavity formed therein is provided and a pouring apparatus is provided adjacent the casting table and adapted to supply molten casting material to the mold cavity of the mold assembly. A casting removal apparatus is provided adjacent the processing table and is adapted to remove the casting from the mold cavity. Molten casting material is poured into the mold cavity of the at least one mold. The casting table is rotated and the mold assembly is transferred from the casting table to the processing table. Next, the casting is removed from the mold assembly and the processing table is rotated.

BRIEF DESCRIPTION OF THE DRAWINGS

The invention will now be described with reference to the drawings in which.

DETAILED DESCRIPTION OF THE PREFERRED EMBODIMENT

Figure 1:
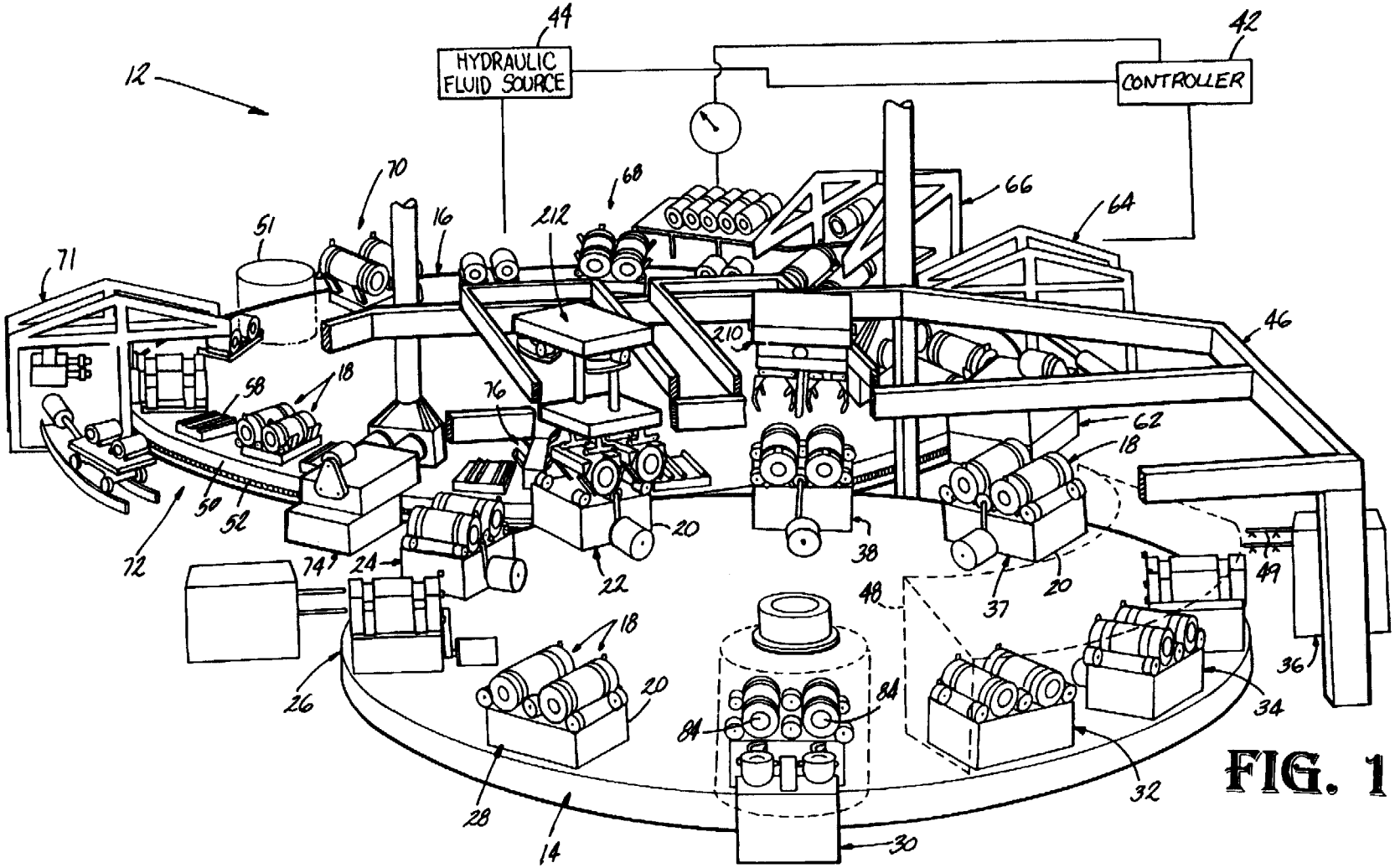
FIG. 1 is a schematic, perspective view of the automated molding system according to the invention.
Figure 17:
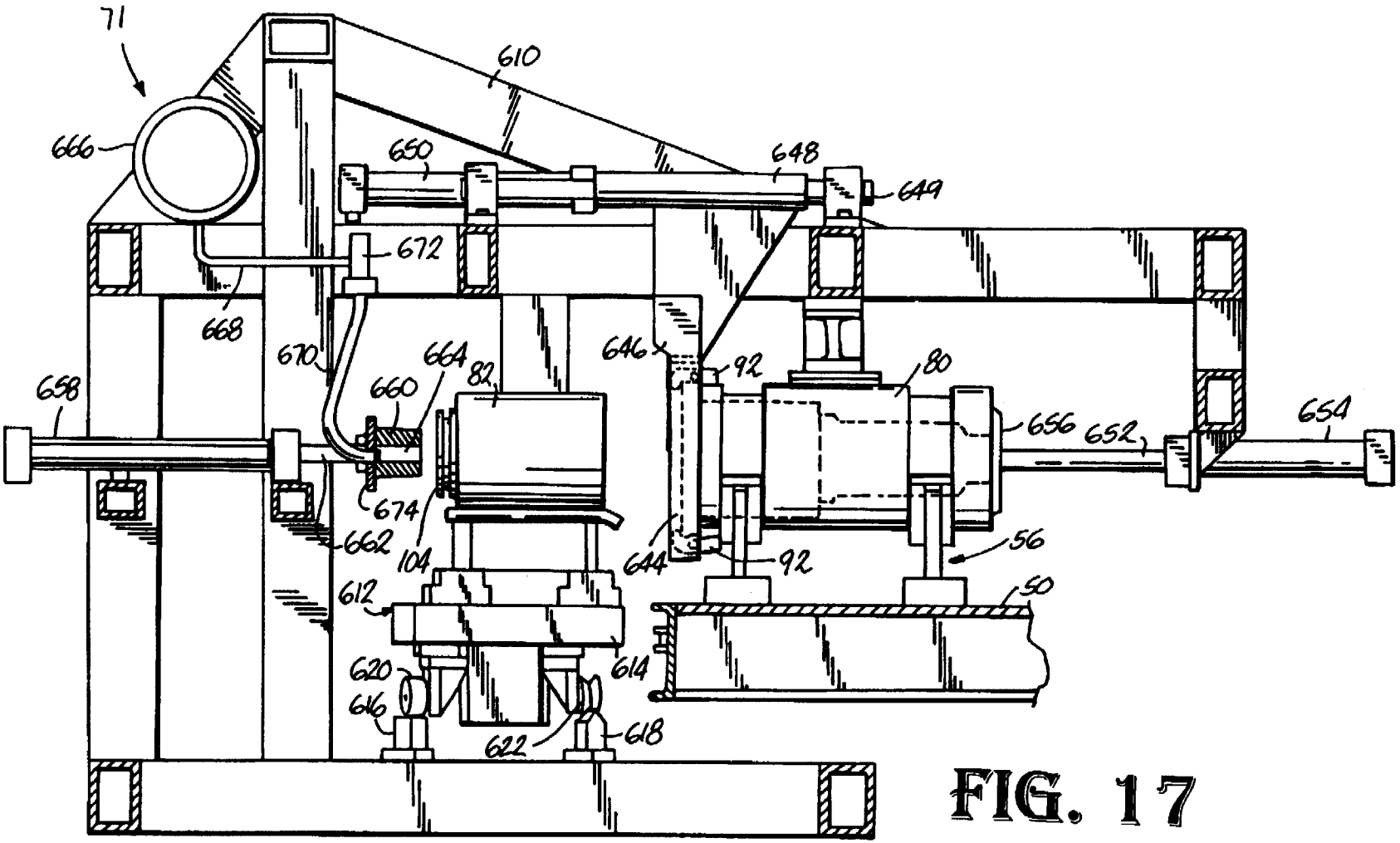
FIG. 17 is a side elevational view of the mold reassembly station of FIG. 1.
Figure 18A:
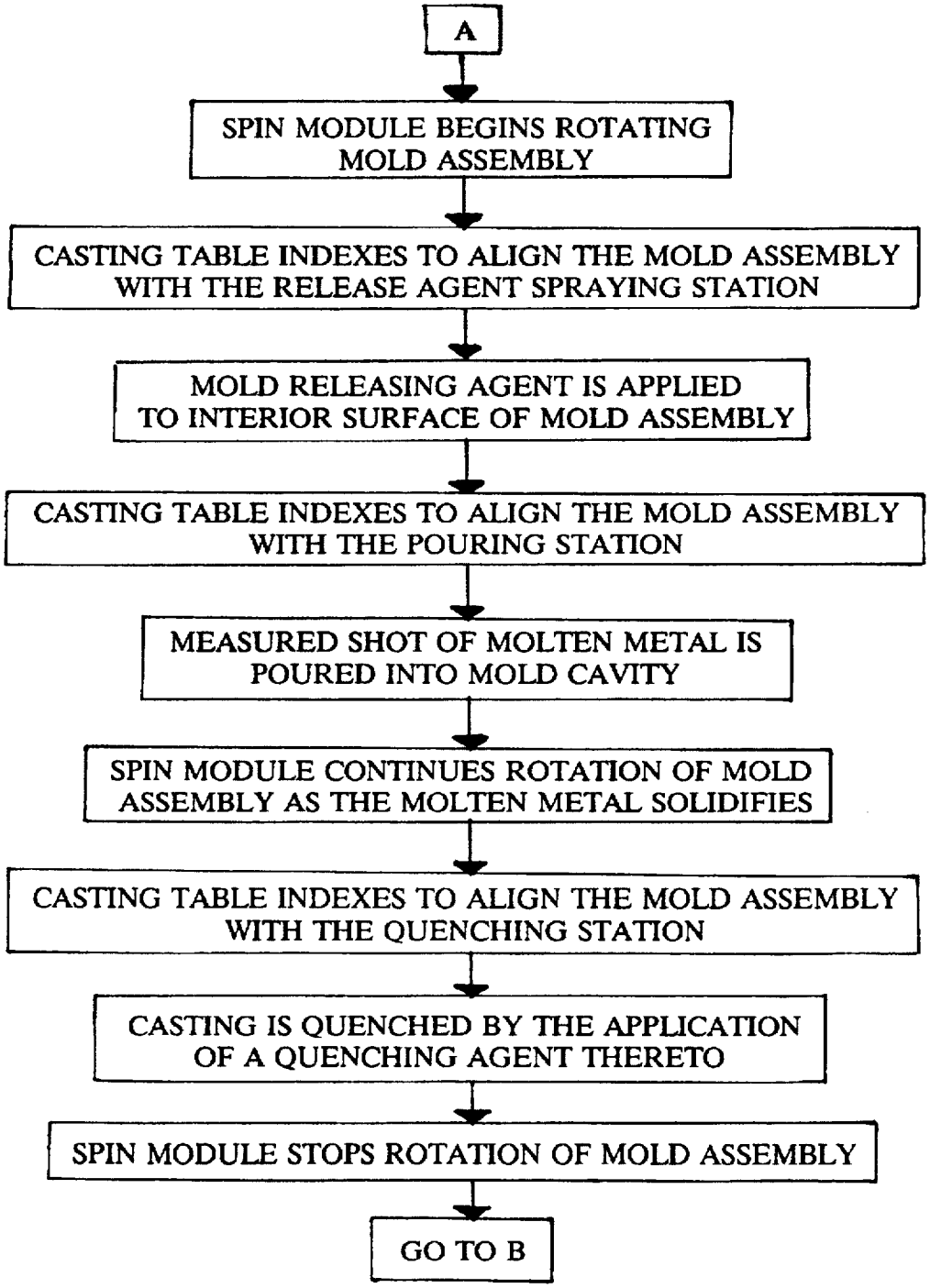
FIG. 18A–C is a flow chart of the automated spin casting system according to the invention.
Figure 18B:
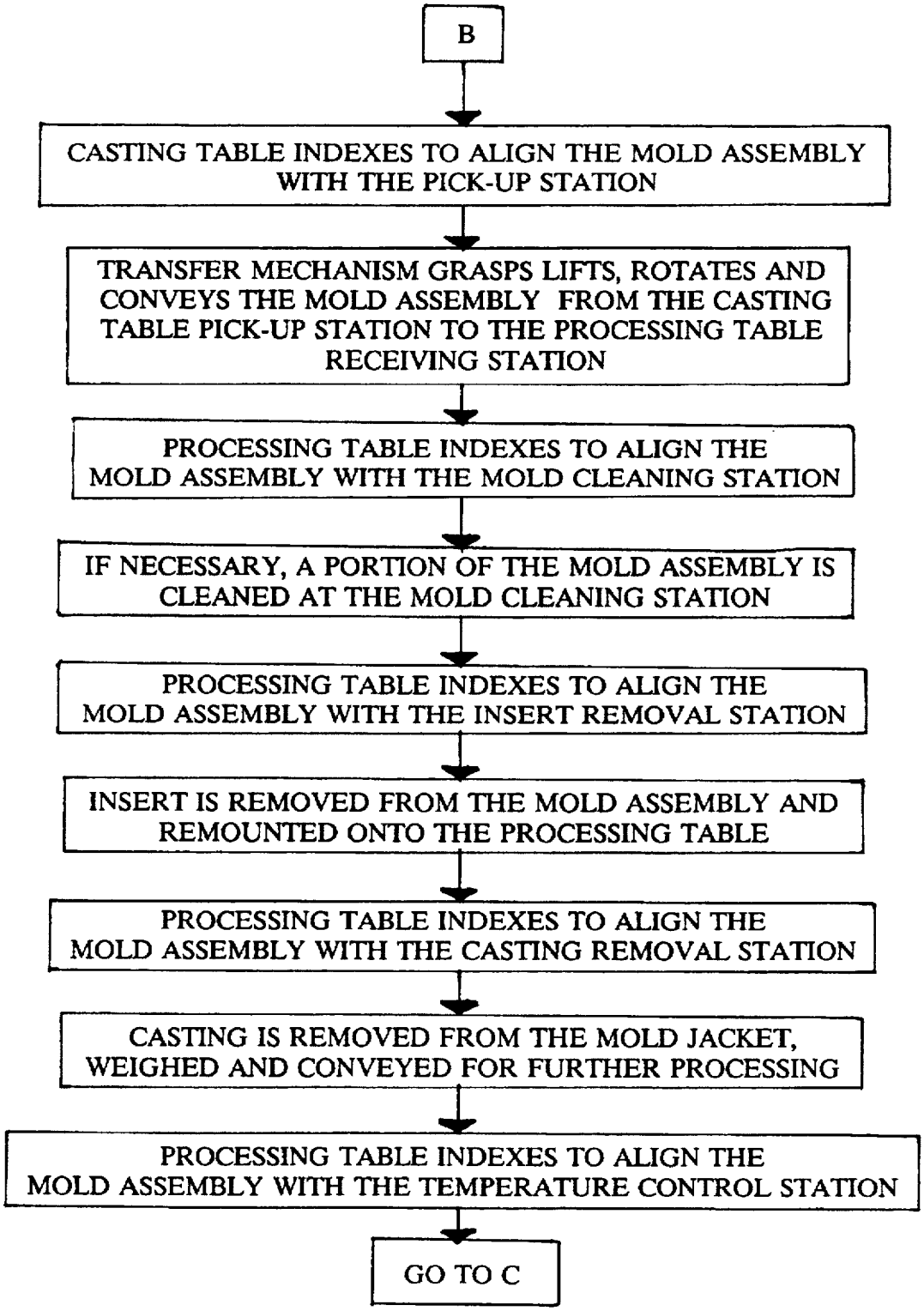
Figure 18C:
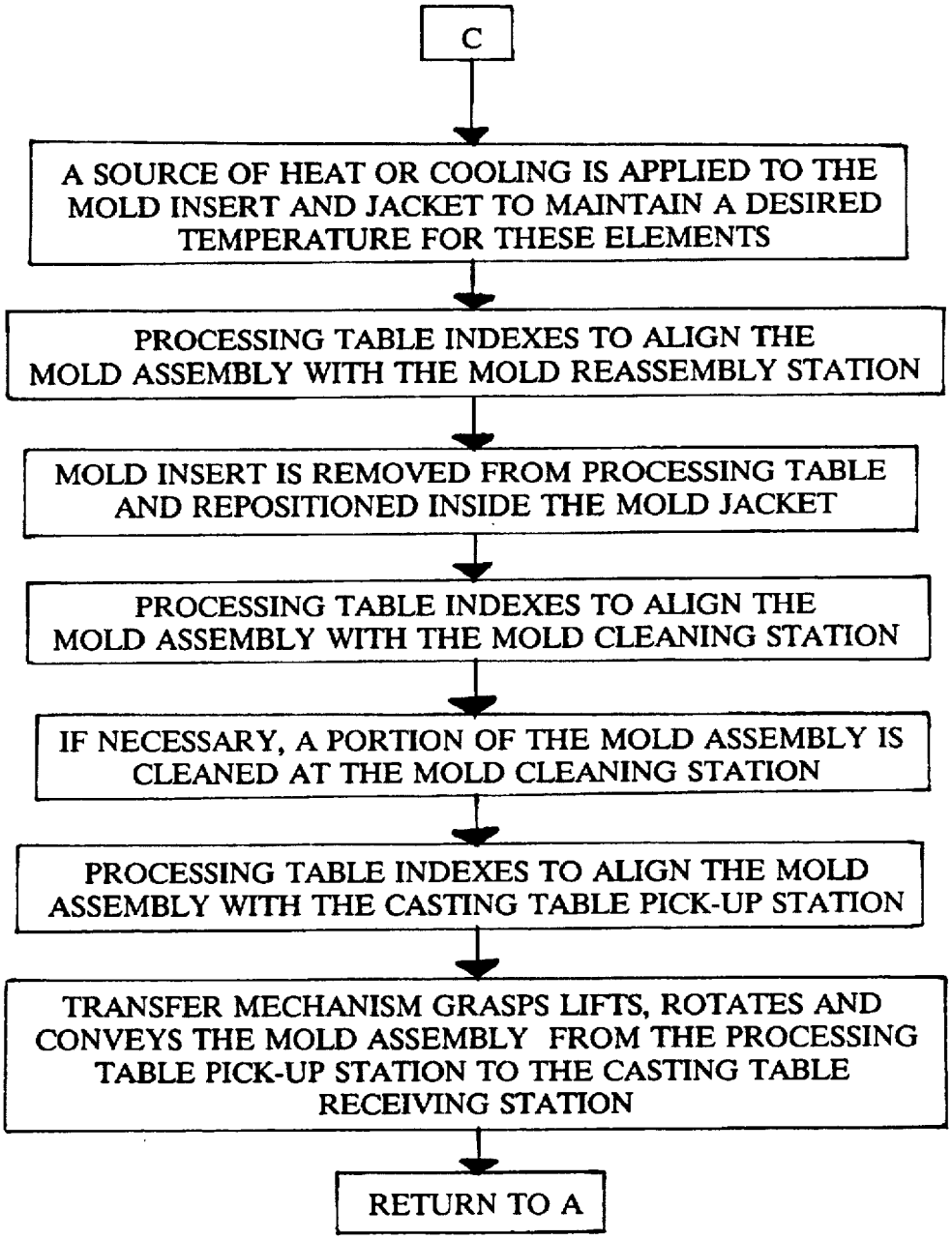

Referring now to the drawings, and to FIGS. 1 and 17 in particular, a system, method and apparatus for the automated production of molded products is shown. The apparatus for carrying out the system and method comprises a rotary casting table 14 and a rotary processing table 16 mounted immediately adjacent one another. The casting table 14 supports a plurality of mold assemblies 18 and indexes these mold assemblies between several operation stations located around the periphery of the casting table. Similarly, the processing table 16 supports a plurality of mold assemblies 18 and indexes the several mold assemblies between several operation stations located around the periphery of the processing table 16. In the preferred embodiment, tubular-shaped sleeves are molded on the casting table 14 by a spin-casting process, the cast sleeves are removed from the mold assemblies 18 on the processing table 16, and the mold assemblies are prepared for additional casting operations at various stations of the processing table 16.

The automated spin-casting system will first be described generally and then each step of the system will be described in greater detail. The first element of the system is the casting table 14 which comprises a turntable 19 with a plurality of spin modules 20 mounted thereon. Each spin module 20 supports and rotates a pair of mold assemblies 18 during the spin-casting process and the several operation stations.

The first station of the casting table 14 is a receiving station 22 which is positioned immediately below a second transfer mechanism 212 for receipt of a mold assembly 18 from the processing table 16. After the mold assembly 18 is lowered onto the spin module 20 at the receiving station 22, the casting table 14 rotates or indexes counter-clockwise as seen in FIG. 1 such that the first mold assemblies 18 are located at an acceleration station 24. At this station, the spinning of the mold assemblies 18 begins. After the proper speed of rotation of the mold assembly 18 has been achieved, the casting table 14 indexes the spin module 20 and mold assemblies 18 to the mold release agent station 26. At this station, a suitable mold release agent is applied to the hollow interior of the mold assembly 18. Next, the casting table indexes the mold assembly 18 to the spin-dry station 28 where the mold assemblies 18 continue to rotate for a time period sufficient for evaporation of the liquid component of the mold release agent. Next, the casting table 14 indexes to a pouring station 30 where a measured amount of molten metal is poured into the hollow mold assembly 18. The next two stations of the casting table 14 are spin-cooling stations where the mold assembly 18 continues to rotate for a time period sufficient for the molten metal to solidify and cool. The next station of the casting table can be a third spin-cooling station or, alternatively can be a quenching station 36 where a suitable quenching agent such as air or water vapor can be sprayed onto the exterior of the mold assembly 18 thereby quenching the casting to obtain the desired microstructure. After the quenching station, the table indexes the spin module 20 and mold assemblies 18 to the deceleration station 37. At this station, the speed of the rotation of mold assemblies 18 on the spin module 20 is gradually decreased and ultimately stopped. The final station on the casting table is a pick-up station 38 which is located immediately below a first transfer mechanism 210. This mechanism 210 lifts the mold assemblies 18 from the casting table 14 and transfers them to the adjacent processing table 16.

The casting table 14 is rotated by a conventional motor. Preferably, a hydrostatic motor 40 is centrally mounted below the casting table 14. The hydrostatic motor 40 is interconnected to a controller 42 and a hydraulic fluid source 44 by conventional conduits. The controller 42 controls the indexing rotation of the casting table 14 and the hydraulic fluid source 44 provides suitable pressurized hydraulic fluid to rotate the casting table 14.

Some spin casting operations require precise control of the temperature of the mold assemblies prior to and following introduction of the molten metal. Therefore, a hood 48 is preferably provided to substantially enclose the casting table 14. The preferred embodiment of the system also requires a relatively large hydraulic or electronic control system for actuating the different elements of the operation stations. Preferably, a structural, overhead framework 46 comprising multiple horizontal and vertical beams are welded to one another to overlie the casting table 14 and hood 48 to create a framework suitable for supporting some or all of the hydraulic and electronic control systems.

The processing table 16 comprises a circular turntable 50 having a drive chain 52 securely mounted to the periphery thereof. An electric motor 54 is mounted immediately adjacent the periphery of the turntable 50, and a drive gear (not shown) or other conventional means extend from the motor 54 to engage the drive chain 52. The motor 54 provides the force of rotation to the drive gear which is in turn transferred to the drive chain and turntable through the interengagement of the drive gear (not shown) with the drive chain 52.

A plurality of mold assembly support modules 56 and mold insert support modules 58 are mounted to and spaced about the periphery of the processing table 16. The support modules 56, 58 are spaced such that the mold assemblies supported thereon are properly positioned at the various processing stations surrounding the processing table.

The first operation station of the processing table 16 comprises a receiving station 60 (FIG. 6) which is positioned adjacent to the pick-up station 38 of the casting table 14. The first transfer mechanism 210 lifts the mold assemblies 18 from the pick-up station 38 of the casting table 14 and deposits them on the mold assembly support module 56 located at the receiving station 60. When the mold assemblies 18 are properly mounted, the processing table 16 rotates counter-clockwise, as seen in FIG. 1 to the next operation station comprising a first mold cleaning station 62. Suitable means such as pressurized air and a rotating brush are used at this station to clean at least a portion of the mold assembly 18. Next, the processing table 16 indexes to the insert removal station 64 when the mold insert 82 is extracted from the mold assembly 18. The removed mold insert 82 is positioned on a particular mold insert support module 58 of the processing table 16. Next, the processing table 16 indexes to the next station comprising the casting removal station 66 for extraction of the cast sleeve from the mold assembly 18. The next two stations in the processing table are temperature control stations where the mold assemblies can be heated or cooled to control the temperature of the mold assembly elements during the processing and casting operations. The processing table indexes again to the next station, namely the mold reassembly station 37. At this station, the mold inserts 82 are removed from the mold insert support module 58 and reinserted into the corresponding mold jacket 80. The next station in the processing table is an interim station 72. No particular processing is currently anticipated at this station. However, further processing or mold preparation activities could be conducted at this station, depending upon the particular application. The next station of the processing table 16 is a second mold cleaning station 74 where the mold assembly 18 can be cleaned and prepared for the casting operation. The final station of the processing table is a pick-up station 76 which is adjacent the receiving station 22 of the casting table 14. The second transfer mechanism 212 is positioned above the pick-up station 76 and transfers the prepared mold assemblies from the processing table 16 to the casting table 14 for additional casting operations.

Figure 2:
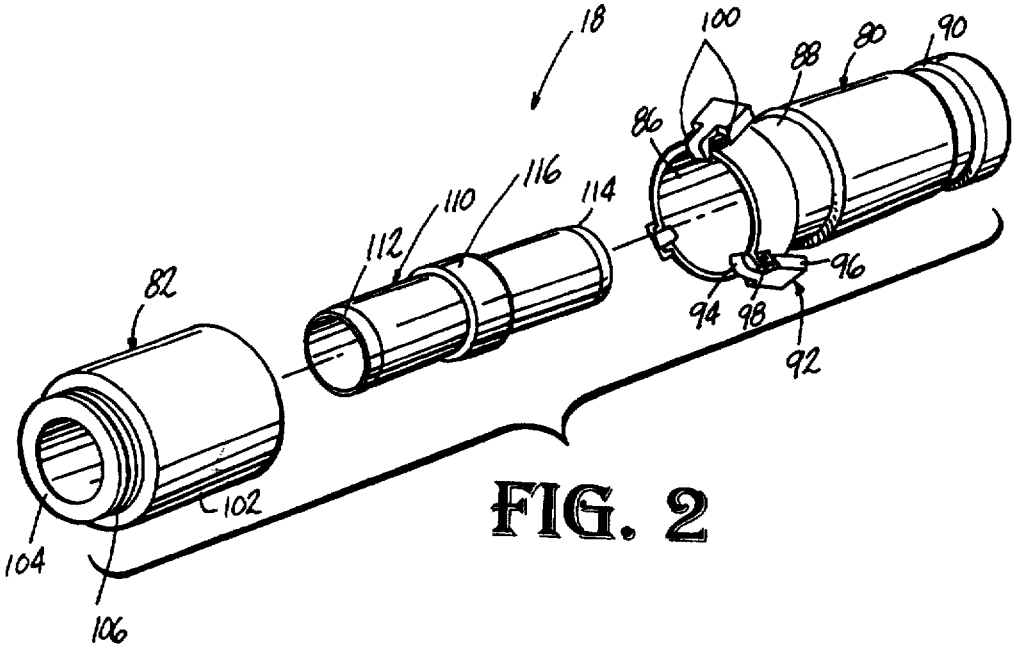
FIG. 2 is an exploded, perspective view of the mold assembly for use in the system of FIG. 1.

Now that the overall system has been generally described, the specific details of the preferred embodiment for spin-casting system will be described in greater detail. As seen in FIG. 2, the preferred embodiment of the mold assembly 18 comprises a mold jacket 80 and a mold insert 82 which is selectively received in the hollow interior of the mold jacket 80. The mold jacket 80 is substantially circular in cross section and has a molten metal aperture 84 (FIG. 1) formed on one end thereof and a mold insert aperture 86 formed on the other end. A pair of roller channels 88, 90 are formed on the outer periphery of the circular mold jacket 80. A plurality of flyweights 92 are mounted immediately adjacent the mold insert aperture 86. The flyweights 92 comprise a gripping portion 94 and a weighted portion 96 wherein the weighted portion has a substantially greater mass than the gripping portion. The flyweights 92 are pivotally mounted to the mold jacket 80 intermediate the gripping and weighted portions 94, 96 by a pivot pin 98 which is received in appropriate mounting flanges 100 extending radially outwardly from the periphery of the mold jacket 80.

The mold insert 82 comprises a substantially hollow, tubular mold body 102 a substantial portion of which is received inside the mold jacket 80 in the assembled position. An end surface 108 is formed on the end of the mold body 102 which is immediately adjacent the flyweights 92 when the insert 82 is received in the mold jacket 80. A boss 104 extends axially outwardly from the end surface 108 of the mold body 102 and is positioned immediately adjacent the flyweights 102 when the insert 82 is properly received in the mold jacket 80. A locking channel 106 is formed circumferentially about the outside perimeter of the boss 104. As the mold assembly 18 rotates on the spin module 20, the centrifugal force exerted on the flyweights 92 pivots the weighted portion 96 outwardly and the gripping portion 94 against the end face 108 of the mold insert 82. The contact of the gripping portion 94 of the flyweight 92 with the end face 108 of the mold insert 82 prevents the inadvertent removal of the insert 82 from the mold jacket 80 during rotation of the mold assembly 18.

The preferred embodiment of the casting 110 created from the mold assembly 18 described above comprises a hollow tubular sleeve having tapered ends 112, 114 and a raised central portion 116. The casting 110 of the preferred embodiment will be cut radially along the mid-point of the casting 110 to create two piston sleeves.

Figure 3:
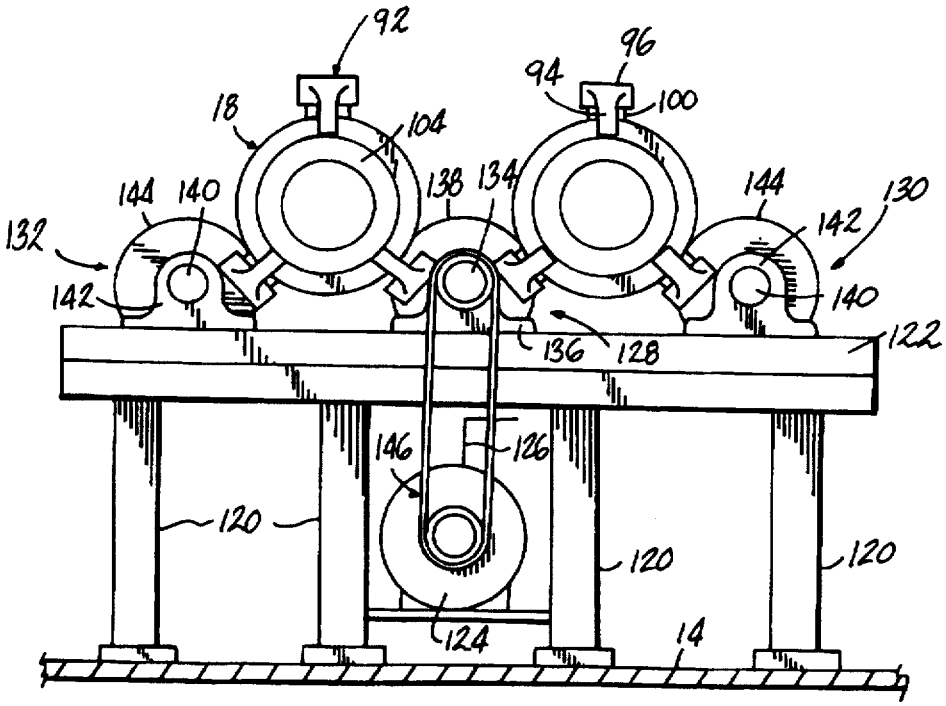
FIG. 3 is a front elevational view of a spin module mounted to the casting table of FIG. 1.

FIG. 3 is a front elevational view of a spin module 20 mounted to the turntable 19 of the casting table 14. The spin module 20 comprises a plurality of support legs 120 mounted to the casting table 14 and a platform 122 supported thereon. A variable speed drive motor 124 is mounted beneath the platform 122 and is interconnected to the controller 42 (FIG. 1) by a suitable conduit 126. The platform 122 supports a centrally mounted drive roller assembly 128 and a pair of slave roller assemblies 130, 132 mounted adjacent thereto. The drive roller assembly 128 comprises a drive shaft 134 which is rotatably supported on the platform 122 by a plurality of beating mountings 136 and a plurality of rollers 138 securely mounted to the drive shaft 134. Similarly, the slave roller assemblies comprise a rotation shaft 140 rotatably received in multiple bearing mountings 142 which are in turn mounted to the platform 122. A plurality of rollers 144 are mounted to the rotation shaft 140. The rollers 138, 144 of the drive roller assembly 128 and slave roller assemblies 130, 132 are positioned on the respective drive shafts such that the rollers are received in the roller channels 88, 90 of the mold jackets 80 when the mold assembly 18 is mounted on the spin module 20. With this structure, the mold assemblies 118 are rotatively supported on the spin modules 20 by the rollers 138, 144.

The drive shaft 134 of the drive roller assembly 128 rotates as a result of the force of rotation supplied to the drive shaft by the motor 124. A conventional interconnecting belt and sheave mechanism 146 interconnects the drive shaft of the drive motor 124 to the drive shaft 134 of the drive roller assembly 128. As drive shaft 134 of the drive roller assembly 128 rotates, the rollers 138 similarly rotate resulting in rotation of the mold assemblies 18. The rollers 144 of the slave roller assemblies 130, 132 freely rotate in response to the rotation of the mold assemblies 18. As the mold assemblies 18 rotate, the flyweights 92 pivot such that the gripping portions 94 engage the mold insert 82.

Figure 4:
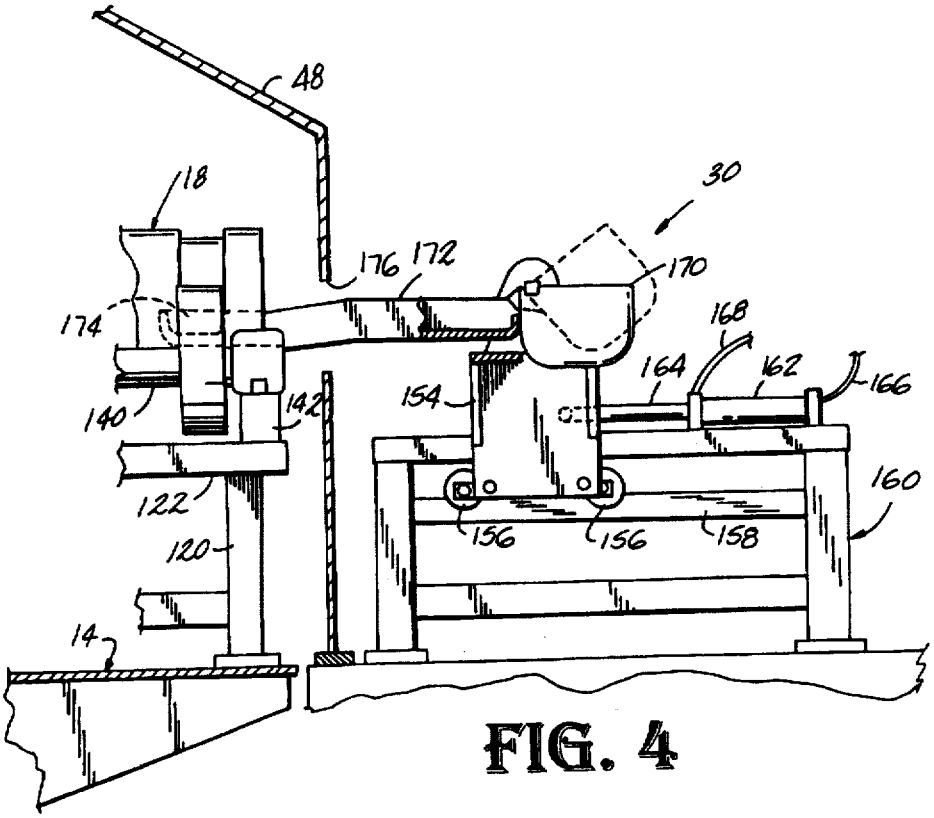
FIG. 4 is a side elevational view of the pouring station of the casting table of FIG. 1.

FIG. 4 shows a side elevational view of the pouring station 30 of the casting table 14 which comprises a ladle cart 154 supported by a plurality of rollers 156 on guide rails 158 of a support framework 160. A conventional hydraulic piston 162 is mounted to the framework 160 and the distal end of the piston rod 164 is mounted to the ladle cart 154. A pair of hydraulic fluid conduits 166, 168 interconnect the hydraulic piston 162 with the hydraulic fluid source 44. Extension and retraction of the piston rod 164 is controlled by the selective application of pressurized fluid to the cylinder 162 through the conduits 166, 168 as dictated by the controller 42.

The automatic casting system 12 according to the invention utilizes numerous hydraulic cylinders for actuating the several elements of the apparatus. Each hydraulic cylinder is interconnected to the hydraulic fluid source 44 through conventional fluid conduit lines as described above. Similarly, the hydraulic fluid source 44 is interconnected to the controller 42 for controlling the supply of pressurized fluid to the several cylinders. The hydraulic cylinder described below will be presumed to be interconnected to the hydraulic fluid source 44 in the same manner as described above, unless expressly noted otherwise.

A pouring ladle 170 is pivotally mounted to the ladle cart 154 and adapted to pour molten iron into a side discharge runner 172 securely mounted to the ladle cart 154. The runner 172 extends forward from the ladle cart a short distance and terminates at a side discharge outlet 174 through which molten metal enters the hollow interior of the mold assembly 18.

The first step in pouring molten metal into the mold assembly 18 comprises positioning at least one spinning mold assembly 18 immediately in front of the ladle cart 154. During the rotation of the casting table 14 for properly position a mold assembly, the piston rod 164 is retracted so that the side discharge runner 172 will not interfere with the rotation of the mold assemblies 18. Once the spinning mold assembly 18 is properly positioned, the piston rod 164 extends such that the side discharge runner 172 extends through a runner aperture 176 formed in the hood 48 into the molten metal aperture 84 (FIG. 1) of the mold jacket 80. When the runner 172 is properly positioned, the ladle 170 is tilted to cause a measured amount of molten iron to be poured into the runner 172 and discharged from the side discharge outlet 174 into the spinning mold assembly 18. The molten metal rotates inside the mold assembly 18 and creates a hollow, tubular sleeve as a result of the centrifugal force acting on the molten metal. The amount of molten metal provided to the mold assembly 18 from the ladle 170 must be precisely controlled to create a sleeve having the proper wall thickness. As described in greater detail below, the amount of metal provided to the ladle 170 is controlled by the controller 42 based upon the weight of the casting resulting from the molding operation.

After the measured amount of molten metal has been provided to the mold assembly 18, the hydraulic piston 162 retracts the piston rod 164 such that the side discharge runner 172 is removed from the mold assembly 18 and will not interfere with the rotation of the casting table 14.

The casting table 14 indexes the spin module 20 and mold assembly to the next two stations of the spin casting table 14, namely spin-cooling stations 32, 34. As seen in FIG. 1, these stations do not involve any special equipment mounted on the spin casting table 14 or adjacent the perimeter of the spin casting table. Rather, these two stations merely involve the continued spinning rotation of the mold assemblies 18 for a time period to sufficiently cool and solidify the castings. A heat or cooling medium can be directed at the mold assemblies 18 at this station depending upon the particular casting conditions.

As an option, a quenching station 36 can be incorporated as a station of the casting table 14. The quenching station 36 is used to quench the mold assembly 18 and the casting contained therein and can be located before, after or intermediate the spin-cooling stations 32, 34. The quenching station applies a cooling fluid such as water, steam, oil or air through spray nozzles 49 (FIG. 1) to the exterior of the mold assembly 18 as the spin module 20 continues to rotate the mold assembly 18. The structure of the quenching station 26 is substantially identical to the mold release agent station 26 described in detail below. While the quenching station has been included in one embodiment of the casting table 14, it is understood that certain molding conditions do not require the quenching operation and, therefore, this station is optional. In the event that the quenching station is not incorporated, then this station could be occupied by an additional spin cooling station, similar to those described above.

After appropriate quenching and cooling operations have been completed, the casting table indexes to the next station, namely the deceleration station 37 (FIG. 1). At this station, the drive motor 154 of the spin module 20 slows from the necessary speed of rotation during the spin-casting, cooling and quenching operations to the stop position. After rotation of the mold assembly stops, then the casting table indexes once again to locate the mold assemblies 18 at the last station of the casting table 14, namely the pick-up station 38.

Upon reaching the pick-up station 38, the mold assembly 18 is ready to be transferred from the casting table 14 to the processing table 16. This transfer operation is accomplished by a first transfer mechanism 210 suspended from the overhead framework 46. A second transfer mechanism 212 (FIG. 1) is utilized to return the prepared mold assemblies to the casting table from the processing table for a repetition of the casting operation. The first and second transfer mechanisms, 210, 212 are identical to one another and therefore only the first transfer mechanism 210 will be described in detail.

Figure 6:
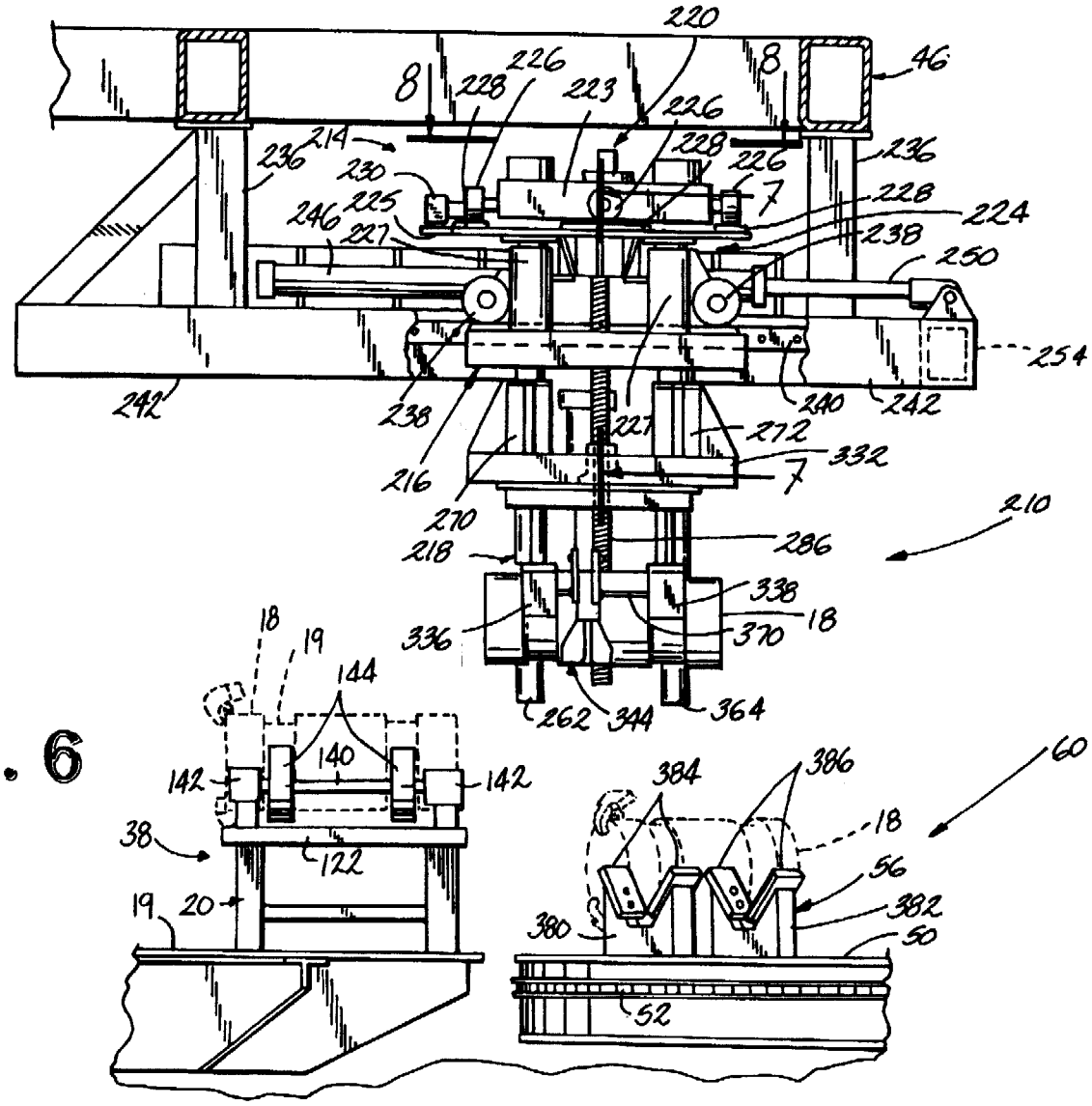
FIG. 6 is a side elevational view of the transfer mechanism of the molding system of FIG. 1.

As seen in FIG. 6, the first transfer mechanism 210 is supported above the casting table 14 pick-up station 38 and the processing table 16 receiving station 60 by suitable vertical and horizontal support members 236, 242, respectively, of the overhead framework 46. As is evident from FIG. 1, the transfer mechanisms are spaced from the tangential intersection point of the casting table 14 and processing table 16 which requires realignment of the mold assemblies 18 during the transfer from the casting table 14 to the processing table 16 and vice versa. The spin modules 20 of the casting table 14 and the mold assemblies support modules 56 of the processing table 16 are aligned on the turntables 19, 50, such that the longitudinal axis of the mold assemblies 18 extends radially outwardly from the center point of the turntables. Therefore, the longitudinal axis of the mold assemblies 18 mounted on the spin module 20 at the casting table 16 pick-up station 38 are not aligned with the longitudinal axis of the mold assembly support module 56 at the receiving station 68 of the processing table 16. Therefore, the transfer mechanism 210 must complete several complex movements in transferring the mold assemblies 18 between the turntables 19, 50. First, the transfer mechanism 210 must lift the mold assembly 18 and then move horizontally from a position overlying the spin module 22 to a position overlying the mold assembly support module 56. The transfer mechanism 210 must also rotate the mold assembly 18 to accommodate the differing axial alignment of the spin module 20 and mold assembly support module 56. Finally, the transfer mechanism 210 must lower the mold assembly 18 onto the mold assembly support module 56. These several movements require the transfer mechanism to move the mold assembly 18 along the x, y and z axes.

The transfer mechanism 210 comprises a rotation head assembly 214, a transfer car assembly 216, a gripper head assembly 218 and a ball screw assembly 220. The rotation head assembly 214 rotates the gripper head assembly 218 the necessary arc of rotation to accommodate the differing axial orientation of the spin module 20 relative to the mold assembly support module 56. The transfer car assembly 216 moves the transfer mechanism 210 along the horizontal plane to traverse the horizontal distance between the spin module 20 and the mold assembly support module 56. The ball screw assembly 220 raises and lowers the gripper head assembly relative to the turntables 19, 50. The gripper head assembly 218 secures the mold assembly 18 to the transfer mechanism 210 during the transfer between the turntables 19, 50.

Figure 7:
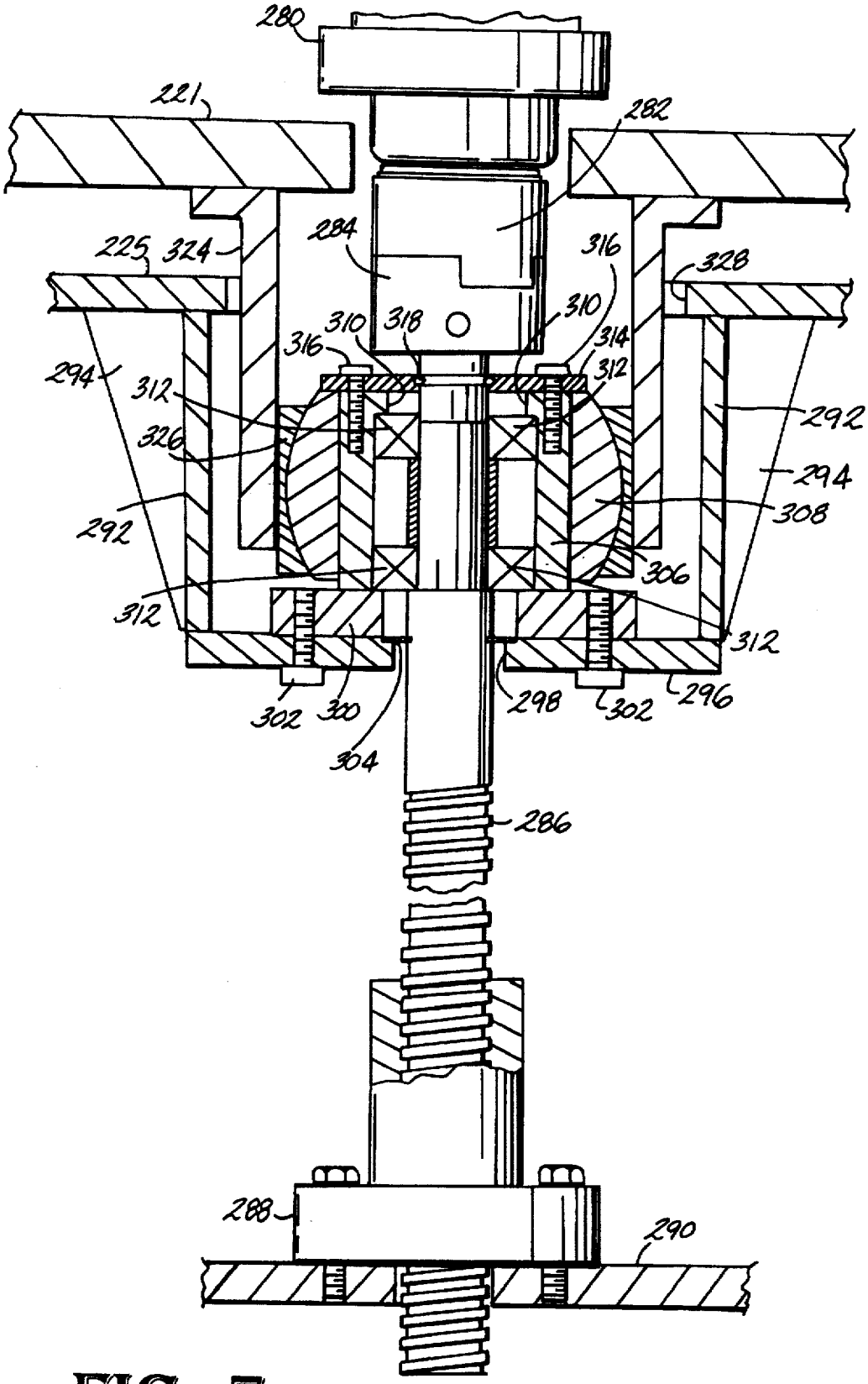
FIG. 7 is a sectional view of the ball screw assembly of the transfer mechanism taken along lines 7—7 of FIG. 6.
Figure 8:
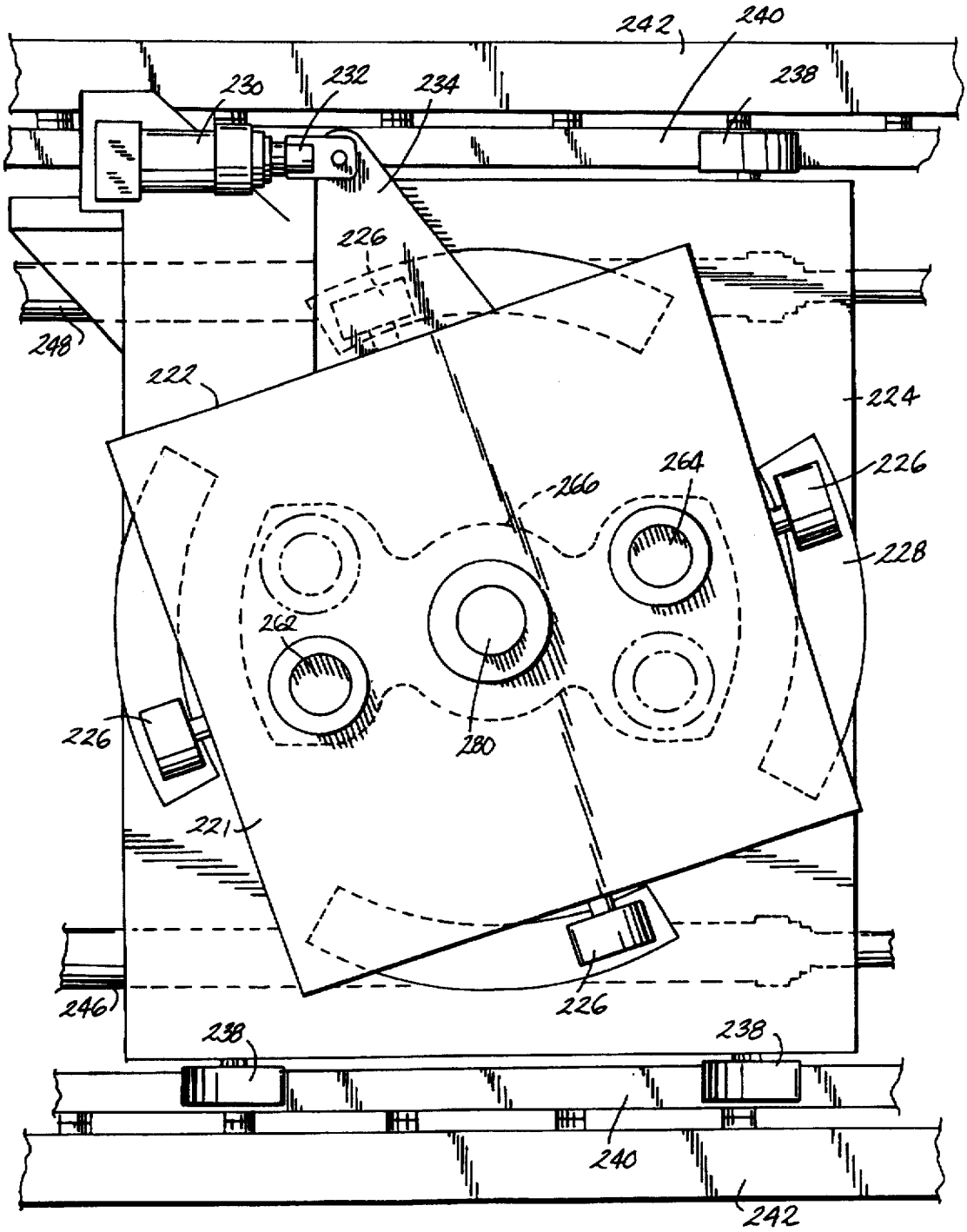
FIG. 8 is a top plan view of the transfer mechanism taken along lines 8—8 of FIG. 6.

As seen in FIGS. 6–8, the rotation head assembly 214 is supported by a rotation head mounting member 222 and the transfer car assembly 216 is supported by a transfer car mounting member 224. The rotation head mounting member comprises a rotation head support plate 221 and a plurality of downwardly extending sidewall members 223 mounted to the bottom surface of the rotation head support plate 221. Similarly, the transfer car mounting member 224 comprises a transfer car support plate 225 and a plurality of support brackets 227 extending downwardly therefrom. The rotation head mounting member 222 is mounted on top of the transfer car support plate 225 for rotation about an arc of approximately 38 degrees. A plurality of rollers 226 extend outwardly from the rotation head sidewall members 223 and are supported on arcuate rails 228 mounted on top of the transfer car support plate 225. Rotation of the rotation head mounting member 222 relative to the transfer car assembly 216 is actuated by a hydraulic cylinder 230 mounted to the transfer car mounting plate 224. The terminal end of the piston rod 232 of the cylinder 230 is pivotally mounted to an outwardly extending rod bracket 234 of the rotation head mounting plate 222. Extension and retraction of the piston rod is controlled by the controller 42 such that the movement of the rod 232 relative to the bracket 234 causes rotation of the rotation head mounting member 222 and rollers 236 on the arcuate rails 238 of the transfer car support plate 225.

The transfer car mounting plate 224 is supported by a plurality of support brackets 227 and a plurality of outwardly extending rollers 238. The rollers 238 traverse horizontal guide rails 240 which are mounted to the horizontal support beam 242 of the overhead framework 46. Horizontal movement of the transfer car mounting plate 224 along the guide rails 240 is actuated by a pair of hydraulic cylinders 246, 248. The cylinders 246, 248 are mounted to the transfer car support brackets 227 and the distal ends of the piston rods 250, 252, respectively of the hydraulic cylinders 246, 248 are mounted to a transverse cross beam 254 extending between the ends of the support beams 242. Extension and retraction of the piston rods 250, 252 results in movement of the multi-head assembly horizontally along the horizontal guide rails 240.

A pair of guide rods 262, 264 extend downwardly from the rotation head assembly 214 through a rod aperture 266 formed in the transfer car support plate 225 to the gripper head assembly 218. The upper ends of the guide rods 262, 264 are securely mounted to the rotation head mounting plate 222 and the lower ends of the rods 262, 264 are slidably received in a pair of guide bushings 270, 272 of the gripper head assembly 218. The bushings 270, 272 are mounted to the gripper head mounting plate 290 (FIG. 9) and accommodate vertical sliding movement of the gripper head assembly 218 along the length of the guide rods 262, 264. Rotation of the rotation head mounting plate 222 about the horizontal plane of the hydraulic cylinder 230 results in rotation of the gripper head assembly 218 in light of the mounting of the guide rods 262, 264 to the gripper head assembly 218. However, the transfer car assembly does not rotate with the gripper head assembly. The rod aperture 266 formed in the transfer car mounting plate 224 is contoured such that the downwardly extending guide rods 262, 264 can freely rotate the necessary arc without interference by the transfer car mounting plate 224.

The ball screw assembly 220 is provided to raise and lower the gripper head assembly 218. As seen in FIG. 7, the ball screw assembly 220 comprises a ball screw motor 280 having a first interconnecting member 282 mounted to the drive shaft (not shown). The first interconnecting member 282 is keyed to mount to a second interconnecting member 284 secured to the top of the ball screw shaft 286. A ball screw nut 288 is threadably mounted on the bottom of the screw shaft 286 and is securely mounted to the gripper head mounting plate 290.

The upper end of the ball screw shaft 286 is supported by the transfer car mounting plate 224. A plurality of side plates 292 and gusset plates 294 are welded to and extend downwardly from the bottom surface of the transfer car support plate 225. A ball screw mounting plate 296 is welded to the bottom edge of the side plates 292 and gusset plates 294. A shaft aperture 298 is formed in the ball screw mounting plate 296 and the ball screw shaft 286 extends downwardly therethrough. An intermediate support plate 300 is fastened to the top surface of the ball screw mounting plate 296 by a plurality of conventional fasteners 302. An elastomeric sealing member 304 is mounted between the adjacent surfaces of the intermediate support plate 300 and ball screw mounting plate 296. The elastomeric sealing member 304 engages the external surface of the screw shaft 286 and limits the dirt and dust entering the bearing assembly. A bearing plate 306, which is circular in cross section, extends upwardly from the intermediate support plate 300. The bearing plate 306 is surrounded by a convex bearing member 308 and the upper edge of the circular bearing plate 306 extends inwardly to create a shoulder 310 which extends radially inwardly from the bearing plate. The shoulder 310 bears against a plurality of compression bearings 312 mounted inside the circular bearing plate 306. The bearings 312 occupy the space between the shoulder 310 and the intermediate support plate 300 at the base of the bearing plate 306. An upper plate 314 is fastened to the top of the bearing plate 306 by suitable fasteners 316 to enclose the compression bearings 312. A suitable aperture is formed in the upper plate 314 through which the shaft 286 extends and an O-ring 318 is mounted intermediate the shaft 286 and the aperture to limit the introduction of dirt and debris into the bearings.

One unique feature of the transfer mechanism is that the ball screw assembly 220 and the gripper head assembly 218 which depends therefrom are supported entirely by the transfer car support plate 225, the rotation head assembly does not support the ball screw assembly 220. However, the ball screw assembly 220 is interconnected to the rotation head support plate 221 by a downwardly extending support member 324 and a concave bearing member 326 which substantially surround the arcuate surface of the convex bearing member 308. The support member 324 is welded to the bottom surface of the rotation head support plate 221 and extends downwardly through an appropriate aperture 328 in the transfer car support plate 225. The concave bearing member 326 is mounted inside the support member 324 to surround the complementary convex bearing member 308. As the rotation head mounting plate 222 rotates, the support member 324 and concave bearing member 326 similarly rotate. However, the ball screw assembly 220 including the concave bearing member 308 are supported by the transfer car mounting plate 224 and therefore do not rotate with the rotation head mounting plate 222. The complementary mounting between the convex bearing member 308 and the concave bearing member 326 provides an effective mounting between the rotation head assembly 214 and the ball screw assembly 220 to prevent excess slop or play between these two members which could result in a swaying or swinging motion of the ball screw assembly 220 relative to the rotation head assembly 214.

Figure 9:
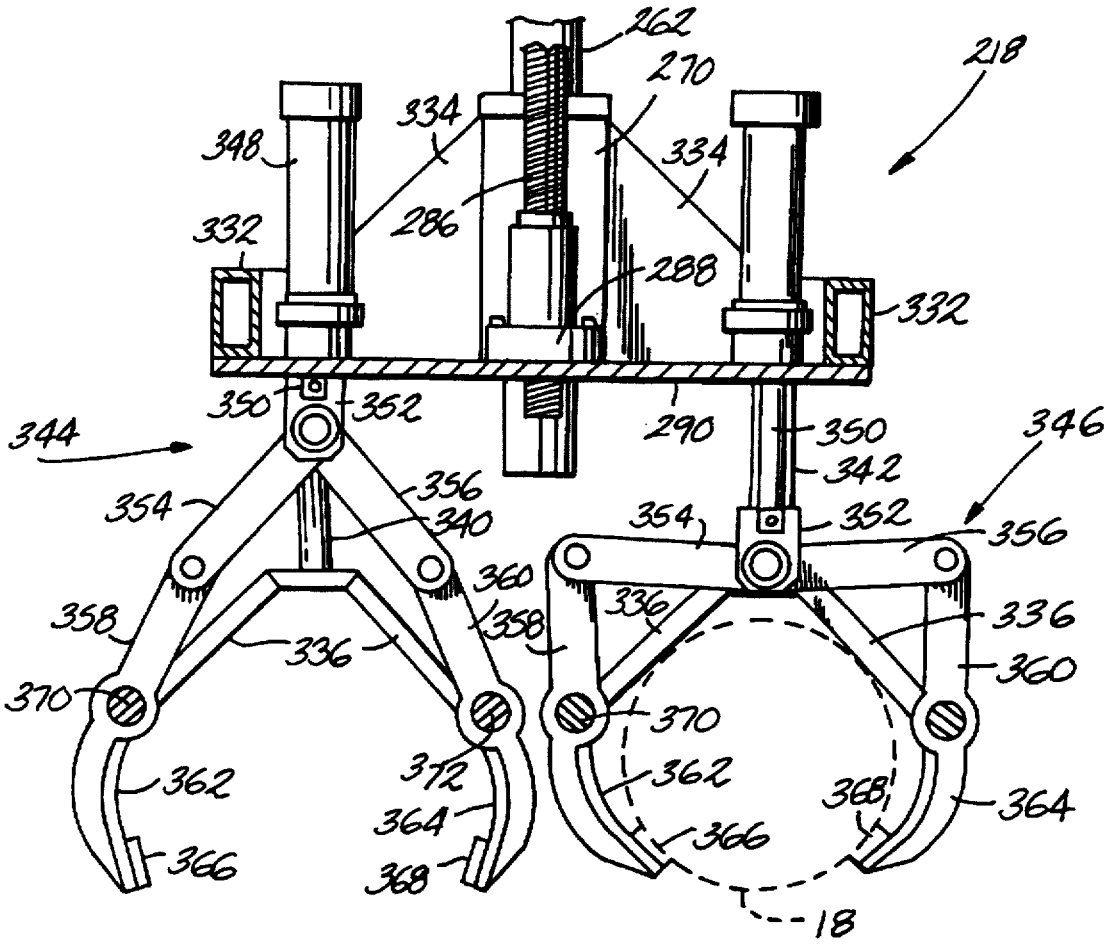
FIG. 9 is a side elevational view of the gripper head assembly of the transfer mechanism of FIG. 6.

The gripper head assembly 218 is adapted to grasp and support the two mold assemblies 18 supported on the spin module 20. As seen in FIGS. 6 and 9, the gripper head assembly 218 comprises the gripper head support plate 290 and a plurality of tubular sidewall members 332 welded to the perimeter of the upper surface of the support plate 290. The previously mentioned guide rod bushings 270, 272 are mounted to the support plate 290 and sidewall members 332. Multiple gusset plates 334 are welded between the bushings 270, 272 and the support plate 290 and sidewall members 332 to stabilize the bushings 270, 272. As described above, the nut 288 of the ball screw assembly 220 is securely mounted to the gripper support plate 290 such that rotation of the shaft 286 causes vertical movement of the support plate 290 and all elements attached thereto.

Two pair of opposed, fixed support pads 336, 338 are mounted to the terminal ends of support rods 340, 342 which extend downwardly from the gripper head support plate 290. The two pairs of fixed pads are positioned and dimensioned to be received in the roller channels 88, 90 of the mold jacket 80. The set of four fixed support pads 336, 338 create a stable, upper mounting for transporting the mold assemblies 18.

The gripper head assembly 218 also comprises a pair of clamping members 344, 346 which are suspended from the gripper support plate 290. The clamping members 344, 346 are identical to one another and therefore only one will be described in detail.

The clamping member 344 comprises a hydraulic cylinder 348 mounted to the support plate 290 and a piston rod 350 which extends downwardly from the hydraulic cylinder 348 through an appropriate aperture (not shown) in the gripper head support plate 290. A pivot bracket 352 is mounted at the terminal end of the piston rod 350 and one end of a pair of first linkage arms 354, 356 are pivotally mounted to the bracket 352. The second end of the first linkage arms 354, 356 are pivotally mounted to a pair of intermediate linkage arms 358, 360. The second end of the intermediate linkage arms 358, 360 are pivotally mounted to one end of clamping arms 362, 364. The second end of the clamping arms have pads 366, 368 mounted thereto. The ends of a pair of support rods 370, 372 are securely mounted to the support pads 336, 338 and the body of the rods 370, 372 pass through suitable apertures in the first end of the clamping arms 362, 364 and the second end of the intermediate linkage arms 358, 360. With this particular mounting structure, the intermediate linkage arms 358, 360 and clamping arms 362, 364 pivot about the longitudinal axis of the support rods 370, 372. The mounting of the support rods 370, 372 to the fixed support pads 336, 338 maintains a predetermined spaced relation between the first ends of the clamping arms 362, 364. Therefore, as the clamping arms 362, 364 pivot about the support rods, the pads 366, 368 mounted at the terminal ends of the clamping arms 362, 366 rotate about the longitudinal axis of the support rods 370, 372.

The pads 366, 368 of the clamping arms 362, 364 are positioned to grasp the lower surface of the mold assembly 18 intermediate the roller channels 88, 90 and fixed support pads 366, 368. When the clamping arms 362, 364 are in the clamped position, the mold assembly 18 is securely clamped in the gripper head assembly 218 through the opposition of the clamping arms pads 366, 368 and the fixed support pads 336, 338. With this particular structure, the mold assembly 18 is supported above, below and at three different points along the length thereof.

Articulation of the clamping arms 362, 364 between the clamped position and the unclamped position is controlled by the hydraulic cylinder 348 which is in turn controlled by the controller 42 (FIG. 1). FIG. 9 shows one of the clamping members 344 in the clamped position and the other clamping member 346 in the unclamped position. While the two clamping members can be controlled independently of one another, the depiction of the two clamping members in the differing clamping states in FIG. 9 is for illustrative purposes. It is preferred that the clamping members 344, 346 will operate in tandem. As the piston rod 350 extends from the hydraulic cylinder 348, the first linkage arms 354, 356 pivot with respect to the pivot bracket 352. Similarly, the intermediate linkage arms 358, 360 pivot with respect to the first linkage arms 354, 356 and with respect to the clamping arms 362, 364 and support rods 370, 372. As the rod extends, the first linkage arms 354, 356 reach the centered position wherein the arms 354, 356 are horizontal and the intermediate linkage arms 358, 360 are vertical. During the extension of the piston rod 350, the rotation of the intermediate linkage arms 358, 360 has resulted in similar rotation of the clamping arms 362, 364 inwardly to grasp the lower surface of the mold assembly 18. Once the first linkage arms 354, 356 reach the centered, horizontal position, the piston rod 350 is extended a short distance further such that the first linkage arms 354, 356 are pivoted slightly beyond the centered, horizontal position. This over-center position effectively locks the clamping arms 362, 364 in the clamped state. In the event of a loss of hydraulic power, the clamping members 344, 346 will not release the mold assemblies 18 because the weight of the mold assemblies biases the first linkage arms 354, 356 into the over-center position. The clamping arms 354, 356 cannot be released from the clamping position until hydraulic power is reestablished to retract the piston rod 350 into the hydraulic cylinder 348. The over-center safety feature for the gripper head assembly 218 is important in light of the fact that the mold assemblies of the preferred embodiment weigh in excess of 1,000 pounds.

The process for transferring the mold assembly from the spin module 20 to the mold assembly support module 56 begins with the rotation of the ball screw shaft 286 to lower the gripper head assembly 218 to engage the mold assembly 18. When the fixed, upper support pads 336, 338 are received in the roller channels 88, 90, then the gripper head hydraulic cylinders 348 extend the piston rods 350 downwardly to pivot the clamping arms 362, 364 into the clamped position. In this position, the mold assembly 18 is supported in the gripper head assembly by the upper support pads 336, 338 and the damping arms 362, 364. Next, the ball screw motor 280 rotates the shaft 286 to lift the mold assembly 18 and gripper head assembly 218. Once the mold assembly 18 has been lifted a sufficient distance, then the transfer car assembly 216 can begin the horizontal movement between the casting turntable 19 and the processing turntable 50. This horizontal movement is accomplished by the retraction of the piston rods 250, 252 of the transfer car cylinders 246, 248. Simultaneous with the horizontal movement, the rotation head assembly 214 actuates to rotate the gripper head assembly 218 the necessary arc of rotation to accommodate the differing axial alignment of the spin module 20 and mold assembly support module 56. In the preferred embodiment, the piston rod of the rotation hydraulic cylinder 230 is extended to rotate the gripper head assembly 218 and mold assemblies 18 supported therefrom approximately 38 degrees.

Once the gripper head assembly 218 is positioned above the mold assembly support module 56 of the receiving station 60 (FIG. 6), the ball screw motor 280 rotates the shaft 286 to lower the gripper head assembly 218 such that the mold assembly 18 is supported on the support module 56. Next, the clamping arms 362, 364 are withdrawn by retraction of the piston rods 350 to release the mold assemblies 18 from the gripper head assembly 218. Finally, the ball screw motor 280 rotates the shaft 286 to raise the gripper head assembly 218 away from the processing turntable 50. Once the gripper head assembly 218 has been raised a sufficient distance, then the turntable 50 is free to rotate to index the mold assembly 18 to the next processing operation.

As seen in FIG. 6, the mold assembly support module 56 comprises a pair of upstanding supports 380, 382 having V-shaped notches formed therein. Pads 384, 386 are mounted to the interior surfaces of the notches. The supports 380, 382 and pads 384, 386 are mounted to the turntable 50 such that the pads 384, 386 are received in the roller channels 88, 90 of the mold jacket 80.

Figure 10:
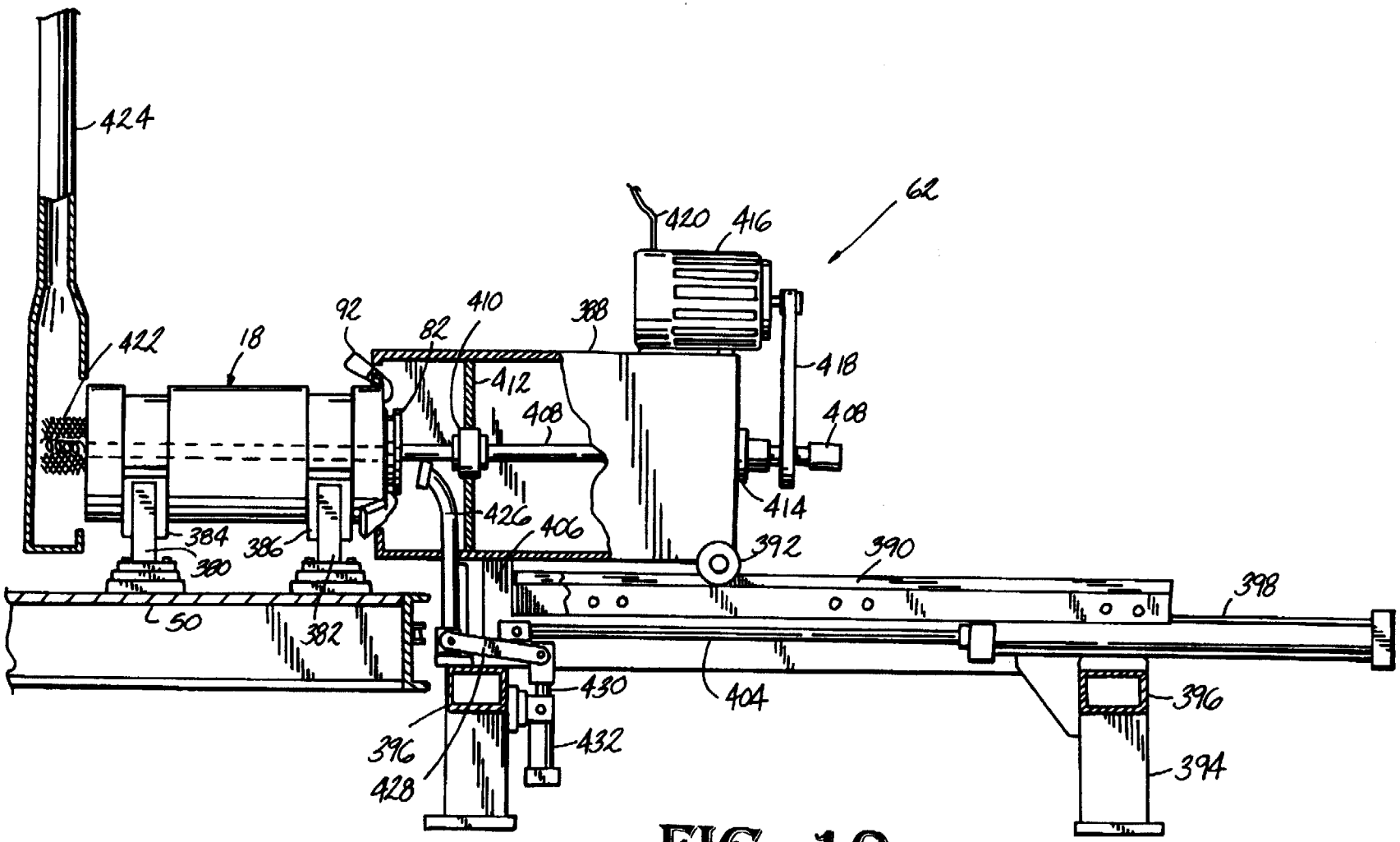
FIG. 10 is a side elevational view of a mold cleaning station of the processing table of FIG. 1.

After the mold assemblies 18 are positioned on the support modules 56, the processing table indexes the support modules 56 from the receiving station 60 to the first mold cleaning station 62. As seen in FIG. 10, the first mold cleaning station 62 comprises a brush housing 388 slidably mounted on guide rails 390 by multiple wheels 392. The guide rails 390 are in turn supported by vertical legs 394 and horizontal beams 396 of a support framework. A hydraulic cylinder 398 is mounted to the support framework and selectively receives pressurized hydraulic fluid from the hydraulic fluid source 44 (FIG. 1). The supply of pressurized fluid to the hydraulic cylinder 398 is controlled by the controller 42. A piston rod 404 extends outwardly from the cylinder 398 in response to the fluid pressure in the cylinder. The distal end of the piston rod 404 is mounted to a bracket 406 which is mounted to and extends downwardly from the brush housing 388. Extension and retraction of the piston rod 404 rolls the brush housing 388 forwardly and rearwardly along the guide rails 390. One end of a pair of brush shafts 408 are rotatably mounted in the brush housing 388. Only one brush is shown in FIG. 10, the other being spaced therefrom an amount equal to the spacing of the adjacent mold assemblies mounted on the turntable 50. Each shaft 408 is supported by a pair of bushings 410, 414 spaced from one another. The first bushing 410 is supported intermediate the ends of the brush housing 388 by an intermediate wall 412. The second bushing 414 is supported in the rear wall of the housing 388. A brush motor 416 is mounted to the top of the housing 388 and is interconnected to the two brush shafts 408 by a belt 418. Operation of the brush motor 416 is controlled by the controller 42 which is electrically interconnected to the controller 42 by a conduit 420. Each brush shaft 408 has a plurality of bristles 422 mounted at the terminal end of the shaft 408. The bristles 422 are dimensioned to contact at least a portion of the interior surface of the mold assembly 18 as the piston rod 404 is extended from the hydraulic cylinder 398. In the preferred embodiment, the bristles 422 are dimensioned to contact only the exposed, interior surface of the mold jacket 80 and mold insert 82 adjacent the ends of the mold assembly 18 and not to contact the interior surface of the casting 110. However, it is understood that the relative length of the bristles 422 could be adjusted to contact any appropriate surface of the mold assembly 18 or casting supported therein.

The first mold cleaning station 62 utilizes air flow to remove dirt and debris from the mold assembly 18 dislodged by the brush bristles 422. An exhaust hood 424 is mounted adjacent the internal end of the mold assembly. A fan is mounted downstream in the hood 424 to draw air from the hollow interior of the mold assembly 18 which is mounted immediately adjacent the opening of the hood.

An insert retention arm 426 is pivotally mounted to one of the horizontal beams 396 of the support framework to prevent inadvertent removal of the mold insert 82 during the brushing operation. The base of the retention arm 426 is securely mounted to a first linkage arm 428 and the other end of the linkage arm 428 is mounted to the terminal end of a piston rod 430 of a hydraulic cylinder 432. The hydraulic cylinder 432 is interconnected to the controller 42 and source of pressurized fluid for extension and retraction of the rod 430. In the retracted position of the piston rod 430, the insert retention arm 426 is spaced from the end of the mold insert 82. As the brush bristles 422 are introduced into the hollow interior of the mold assembly 18, the piston rod 430 is extended thereby pivoting the linkage arm 428 and insert retention arm 426. The insert retention arm 426 is pivoted such that the top of the arm 426 abuts the end of the mold insert 82 thereby preventing inadvertent removal of the insert 82 potentially caused by the insertion or removal of the brush therefrom.

Figure 11:
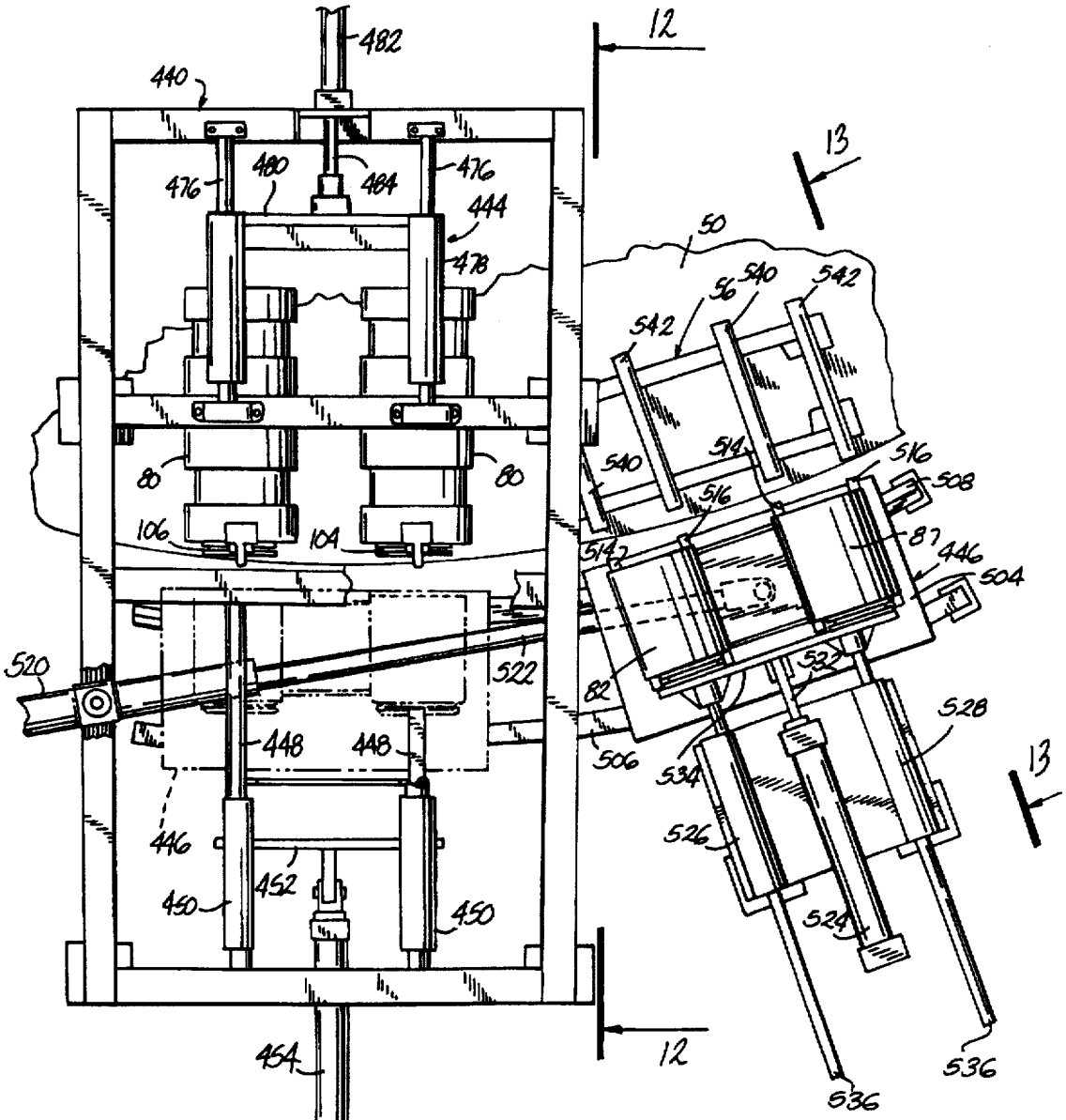
FIG. 11 is a top plan view of the insert removal station of the processing table of FIG. 1.
Figure 12:
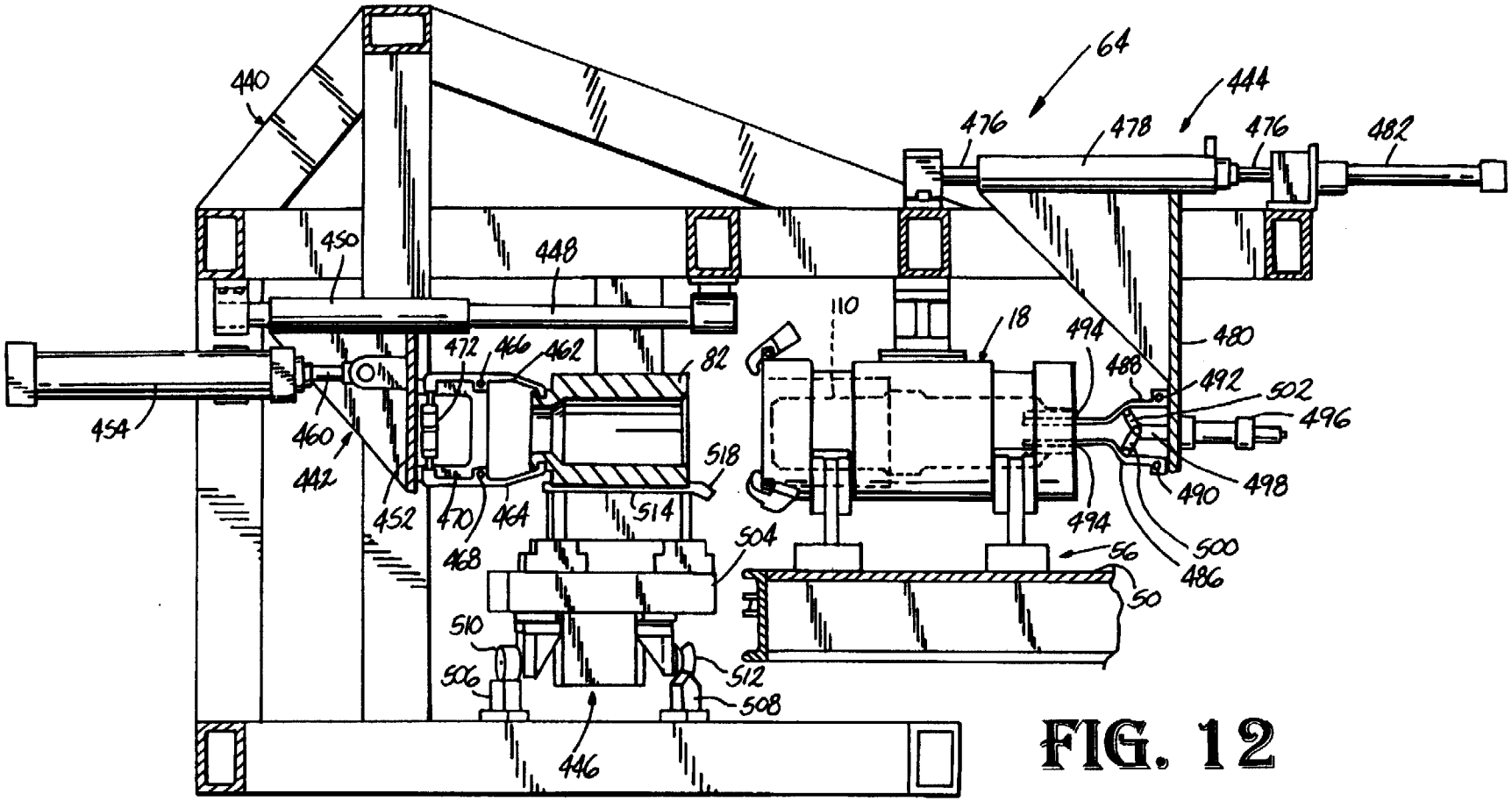
FIG. 12 is a side elevational view of the insert removal station taken along lines 12—12 of FIG. 11.
Figure 13:
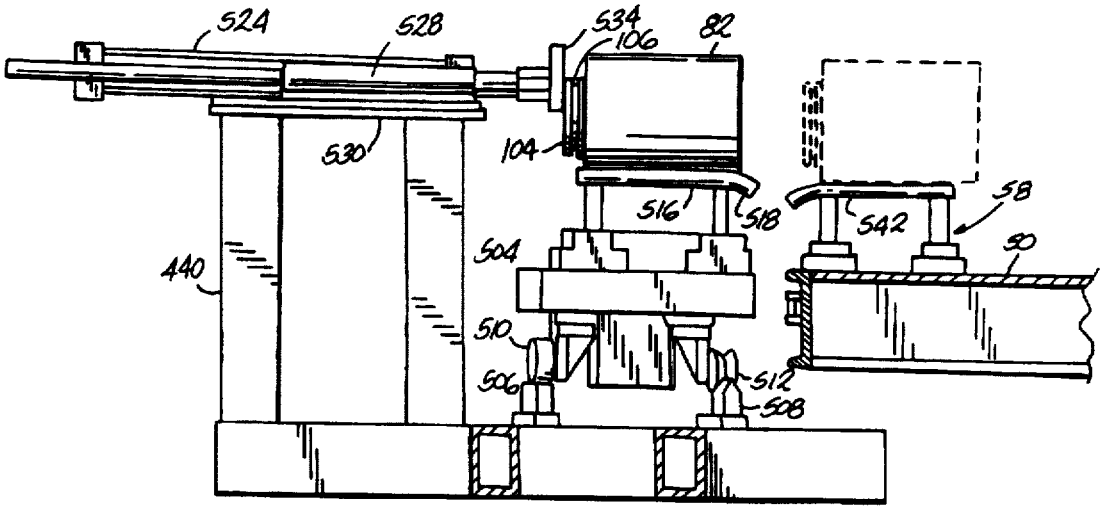
FIG. 13 is a side elevational view of the transfer car assembly of the insert removal station taken along lines 13—13 of FIG. 11.

After at least a portion of the mold assembly 18 has been cleaned at the first mold cleaning station 62, the turntable 50 of the processing table indexes to locate the pair of mold assembly support modules 56 immediately in front of the insert removal station 64. As seen in FIGS. 11–13, the insert removal station 64 comprises a support framework 440 having an insert removal mechanism 442, a casting retention mechanism 444 and a mold insert transfer cart 446 mounted thereto. The insert removal mechanism 442 comprises a guide rod 448 suspended from the support framework 440 and extending radially outwardly from the turntable 50. A bushing 450 is slidably supported on the guide rod and a support bracket 452 extends downwardly from the bushing 450. A hydraulic cylinder 454 is mounted to the support framework 440 rearwardly of the support bracket 452. A piston rod 460 is extended and retracted from the cylinder 454 in response to the internal fluid pressure of the cylinder 454. The distal end of the piston rod 460 is mounted to the rear of the support bracket 452.

A mounting bracket 470 is secured to the support bracket 452. A pair of opposed gripper arms 462, 464 are pivotally mounted by pivot pins 466, 468 to the support bracket 452. The opposed gripper arms 462, 464 are actuated between a gripping position and a released position by an actuator 472 mounted to the mounting bracket 470 intermediate the internal ends of the gripper arms 462, 464.

The casting retention mechanism 444 is supported by the support framework 440 opposite the insert removal mechanism 442. The casting retention mechanism 444 comprises a pair of guide rods 476 mounted to the framework 440 and a pair of bushings 478 slidably mounted thereon. A support bracket 480 extends downwardly from the bushing 478. A hydraulic cylinder 482 is mounted to the support framework 440 to the rear of the bushings 478 and controls movement of the bushings 478 and bracket 480 along the guide rods 476 through the selective extension and retraction of the piston rod 484 mounted to the bracket 480. A pair of casting retention arms 486, 488 are pivotally mounted to the base of the support bracket 480 by a pair of pivot pins 490, 492. Pads 494 are mounted to the terminal ends of the retention arms 486, 488 and are adapted to contact the interior surface of the casting during the removal of the mold insert 82 from the mold assembly 18. The retention arms 486, 488 are adapted for movement between an extended position in which the pads 494 contact the casting and a retracted position wherein the pads 494 are spaced from the casting 110 and mold assembly 18. Actuation of the retention arms 486, 488 between these two positions is controlled by a hydraulic cylinder 496 mounted to the support bracket 480. The terminal end of the piston rod 498 is pivotally connected to a pair of linkage arms 500, 502. The terminal ends of the arms 500, 502 are mounted to the interior surface of the retention arms 486, 488 such that extension of the piston rod 498 relative to the support bracket 480 causes expansion of the ends of the retention arms 486, 488 sufficient to contact the internal surface of the casting. Similarly, retraction of the piston rod 498 retracts the ends of the retention arms 486, 488 from contact with the casting.

The transfer cart 446 comprises a support platform 504 which is rollably supported on a pair of guide rails 506, 508 by a pair of support wheels 510, 512. Preferably, one of the guide rails 506 is a floating rail and has a flat horizontal surface for supporting the wheel 510. The other rail 508 is a fixed rail and has a peaked surface for supporting a complementary wheel 512. With this particular structure, the proper alignment of the transfer car will be maintained as mold inserts 82 are pulled onto and pushed off of the cart 446.

A pair of insert support rails 514, 516 are mounted to the platform 505 at a height which is horizontally aligned with the mold assembly 18. The inboard ends 518 of the rails 514, 516 are tapered downwardly such that the mold inserts 82 can be slidably received on the rails 514, 516.

The transfer cart 446 is adapted for movement between an insert receiving position as seen in FIG. 12 and an insert discharge position as seen in FIGS. 11 and 13. Movement of the cart 446 between these two positions is controlled by a hydraulic cylinder 520 which is pivotally mounted to the support framework 440 and a piston rod 522 which is pivotally mounted to the transfer cart 446. As seen in FIG. 11, the guide rails 506, 508 of the transfer cart 446 are arcuate along a horizontal plane, the arc of the rails 506, 508 following the arc of the perimeter of the processing table 50 such that the spacing between the transfer cart 446 and the turntable 50 remains constant between the two positions of the cart. The cylinder 520 and rod 522 are pivotally mounted to the support framework 440 and transfer cart 446 to accommodate the arcuate movement of the transfer cart 446 along the rails 506, 508.

In operation, the mold inserts 82 are removed from the mold assemblies 18 while the castings 110 remain inside the mold jackets 80. First, the transfer cart 446 is positioned immediately in front of the mold assembly support module 56. The piston rod 460 of the cylinder 454 is extended such that the gripper arms 462, 464 are immediately above and below the boss 104 of the mold insert 82. Next, the gripper arms 462, 464 are pivoted such that the terminal ends of the arms 462, 464 are received in the locking channel 106 of the boss 104.

Once the gripper arms 462, 464 are received in the locking channel 106, the hydraulic cylinder 454 retracts the piston rod 460 thereby withdrawing the insert 82 from the mold jacket 80 and sliding the insert 82 onto the support rails 514, 516. The downwardly turned inboard ends 518 of the support rails 514, 516 help guide the insert 82 onto the body of the rails. Once the inserts 82 are fully mounted on the rails 514, 516, the gripper arms 462, 464 are retracted out of engagement with the locking channel 106. Next, the cylinder 454 retracts the piston rod 460 thereby drawing the support bracket 452 and gripper arms 462, 464 rearwardly, away from the insert 82 and transfer cart 446.

Simultaneous with the grasping of the insert 82, the casting retention mechanism 444 is positioned to hold the casting 110 inside the mold jacket 82. First, the piston rod 484 of the hydraulic cylinder 482 is extended such that the bracket 480 slides along the guide rods 476 until the retracted casting retention arms 486, 488 are positioned inside the mold jacket 82. Next, the piston rod 498 of the cylinder 496 extends such that the pads 494 mounted at the ends of the retention arms 486, 488 contact the interior surface of the casting 110. The casting retention mechanism 444 will hold the casting 110 in the mold jacket 80 until the insert 82 has been fully removed therefrom. Once the insert 82 has been removed, the piston rod 498 is retracted into the cylinder 496 thereby causing the retention arms 486, 488 to retract out of contact with the casting 110. Finally, the piston rod 484 of the cylinder 482 is retracted to remove the retention arms 486, 488 from the hollow interior of the mold jacket 80. The retention arms 486, 488 are removed a sufficient distance such that they will not interfere with the rotation of the casting table 50 and the mold assemblies 18 mounted thereon.

Once the insert 82 has been mounted on the transfer car and the support bracket 452 withdrawn therefrom, the hydraulic cylinder 520 extends piston rod 522 therefrom to roll the transfer car along the rails 506, 508 about the perimeter of the turntable 50 until the inserts 82 are positioned immediately in front of a mold insert support module 58 mounted on the turntable 50. As seen in FIGS. 11 and 13, a hydraulic cylinder 524 and a pair of guide bushings 526, 528 are mounted to a support platform 530 of the support framework 440. The terminal end of the piston rod 532 is mounted to a vertical push plate 534. A pair of guide rods 536, 538 are similarly mounted to extend rearwardly from the push plate 534 and are received in the bushings 526, 528, respectively. The hydraulic cylinder 524 is adapted to extend the push plate 534 between a retracted position and an extended position. The mold inserts 82 are slid from the transfer cart 446 to the insert support module 58 of the turntable 50 through the extension of the push plate 534. Once the inserts 82 are positioned in front of the support module 58, the hydraulic cylinder 524 extends the rod 532 until the push plate 534 contacts the end of the bosses 104 of the two inserts 82. Continued extension of the rod 532 pushes the inserts 82 from the support rails 514, 516 of the transfer cart 446 to the support rails 540, 542 of the insert support module 58. Once the inserts 82 are fully received on the support module 58, then the rod 532 is retracted into the cylinder 524 thereby with drawing the push plate 534 away from the inserts 82. The guide rods 536, 538 and bushings 526, 528 help maintain proper alignment of the push plate 534 with respect to the inserts 82 and transfer cart 446. Once the inserts 82 have been repositioned on the turntable 50, the transfer cart 446 is withdrawn to the receiving position as seen in FIG. 12. Preferably, the transfer cart 446 is repositioned for withdrawal of the next pair of inserts during indexing of the turntable.

The insert removal station 64 withdraws the inserts 82 from the mold assemblies 18 mounted on the turntable 50 and places the inserts 82 on the turntable 50 immediately adjacent the corresponding pairs of assemblies 18. As will be described below, each mold insert 82 will remain paired with the same mold jacket 80 throughout multiple repetitions of the process. This results in better quality control for the resulting casting.

Figure 14:
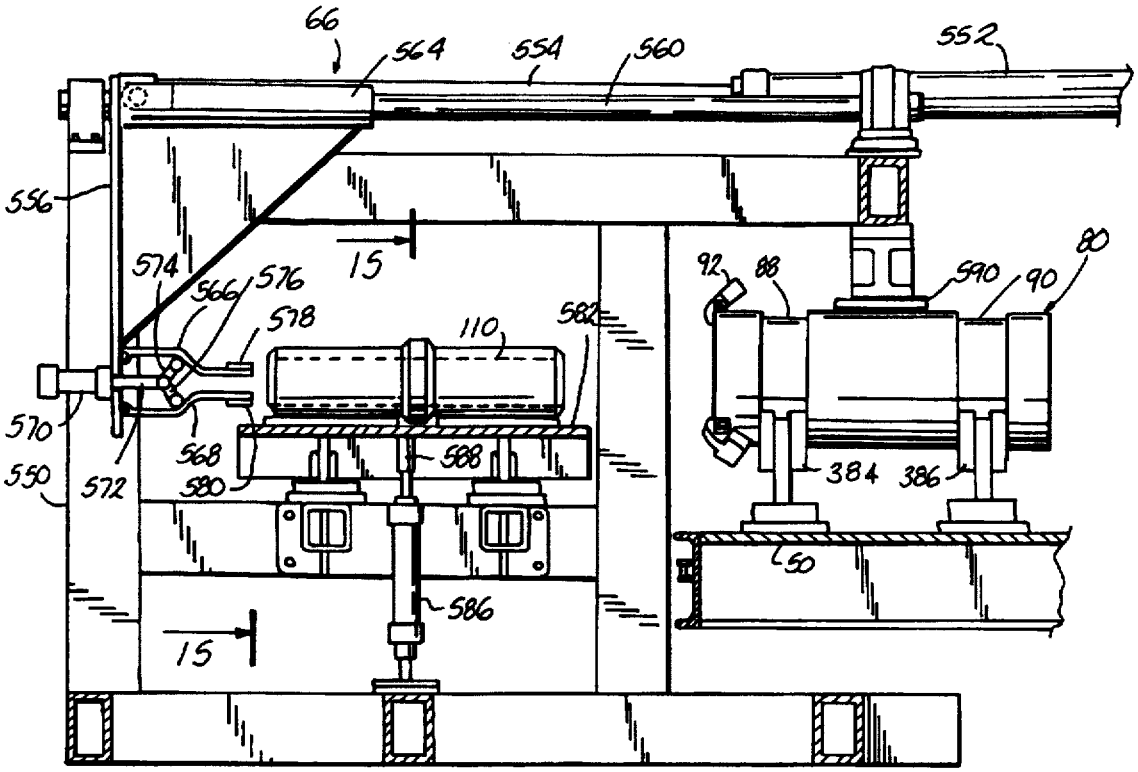
FIG. 14 is a side elevational view of the casting removal station of the processing table of FIG. 1.
Figure 15:
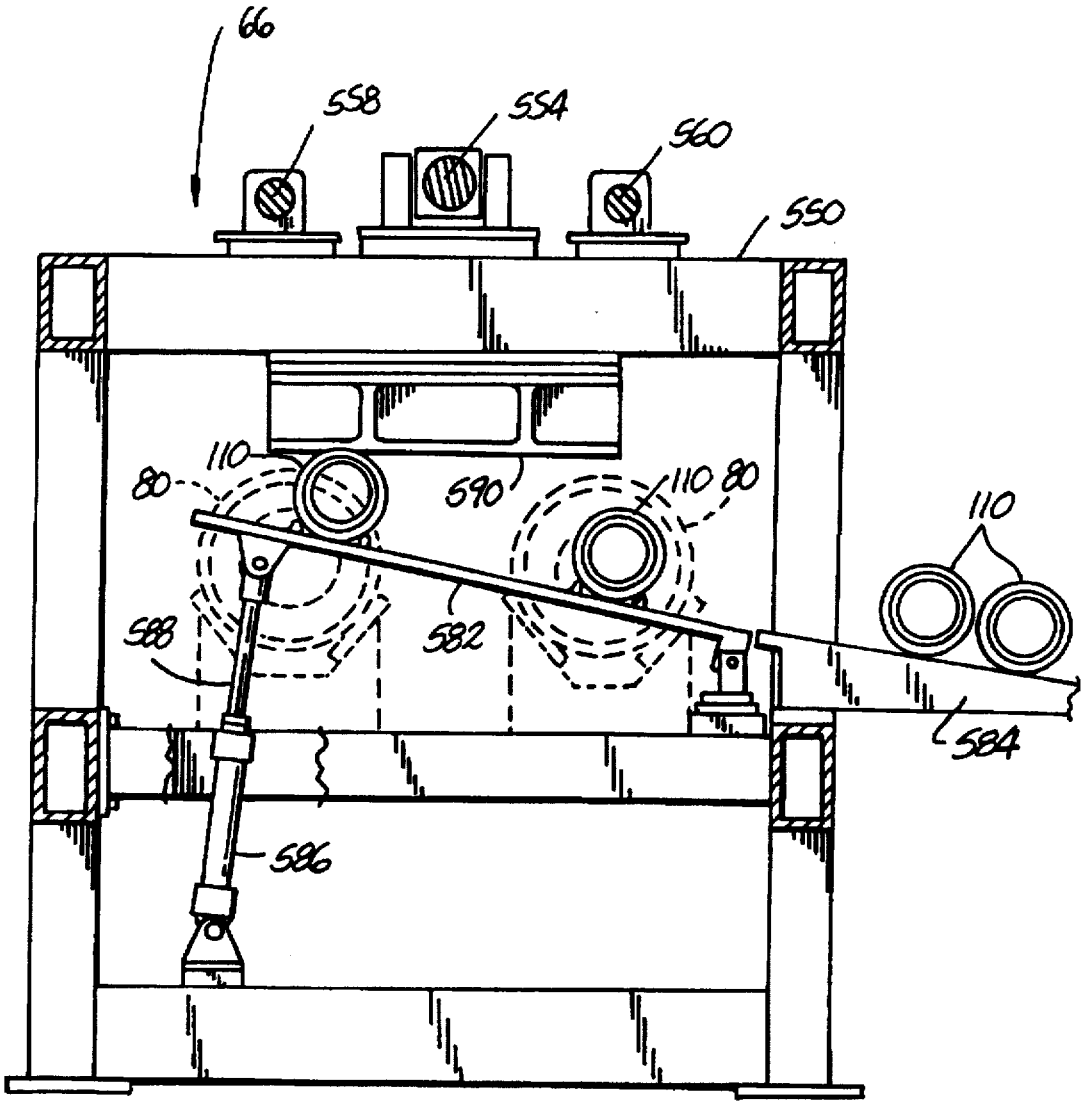
FIG. 15 is a front elevational view of the casting removal station taken along lines 15—15 of FIG. 14.

After the mold inserts 82 have been removed from the mold jacket 80 and placed onto the turntable 50, the turntable indexes the mold assemblies 18 to the casting removal station 66. At this station, the casting 110 is extracted from the mold jacket 80 and transferred away from the processing table 16 for additional processing such as cutting grinding and cleaning. As seen in FIGS. 14 and 15, the casting removal station 66 comprises a support framework 550 mounted immediately adjacent the turntable 50 for supporting the casting removal assembly. A hydraulic cylinder 552 is mounted to the top of the support framework and the terminal end of the cylinder piston rod 554 is mounted to a downwardly extending support bracket 556. A pair of guide rods 558, 560 are also mounted to the top of the support framework 550 and a pair of bushings 562, 564 are slidably mounted on the guide rods 558, 560 and are securely mounted to the support bracket 556. Therefore, extension and retraction of the piston rod 554 from the hydraulic cylinder 552 results in movement of the bushings 562, 564 and support bracket 556 along the length of the guide rods 558, 560. A pair of opposed gripper arms 566, 568 are pivotally mounted to the base of the support bracket 556 for articulation between expanded and retracted positions by a hydraulic cylinder 570, also mounted to the base of the support bracket 556. The piston rod 572 of the hydraulic cylinder 570 has a pair of linkage arms 574, 576 pivotally mounted to the end thereof. The other ends of the linkage arms 574, 576 are pivotally mounted to the gripper arms 566, 568. A pair of pads 578, 580 are mounted to the terminal ends of the gripper arms 566, 568 for contacting the interior surface of the casting 110.

The mold jacket 80 is prevented from movement relative to the turntable 50 as the casting 110 is extracted as a result of the support pads 384, 386 received in the roller channels 88, 90 of the mold jacket and a downwardly extending stop pad 590 mounted to the support framework 550. The support pads 384, 386 received in the channels 88, 90 prevents lateral movement of the mold jacket 80 and the stop pad 590 mounted immediately above the jacket 80, in conjunction with the support pads 84, 86 prevents the jacket 80 from tipping relative to the turntable 50.

In operation, the turntable 50 indexes to locate a pair of mold jackets 80 having castings 110 mounted therein immediately in front of the gripper arms 566, 568. Once the mold jackets are properly positioned, the hydraulic cylinder 552 retracts the piston rod 554 until the gripper arms 566, 568, which are in the retracted position, are received inside the hollow interior of the casting 110. Next, the hydraulic cylinder 570 extends the piston rod 572 to cause expansion of the terminal ends of the gripper arms 566, 568 until the pads 578, 580 snugly contact the interior surface of the casting 110. While the hydraulic cylinder 570 maintains sufficient gripping pressure on the casting 110, the piston rod 554 of the cylinder 552 is extended causing the support bracket 556, gripper arms 566, 568 and castings 110 supported thereon to move radially outwardly relative to the turntable 50, thereby extracting the casting 110 from the mold jacket 80. The castings 110 are slid onto a support platform 582. Once the castings 110 are properly positioned above the platform, the hydraulic cylinder 570 retracts the piston rod 572 such that the gripper arms 566, 568 retract from the interior surfaces of the casting. Next, the piston rod 554 is further extended from the cylinder 552 to withdraw the gripper arms 566, 568 from the end of the castings 110 and prevent interference of the gripper arms with the removal of the casting from the insert removal station 66.

The castings 110 are transferred from the insert removal station 66 to a ramp 584 for transferral to additional processing operations by a hydraulic cylinder 584 which is mounted immediately below the support platform 582. The piston rod 586 of the cylinder 584 is pivotally mounted to one end of the platform 582. The other end of the platform 582, pivotally mounted to the support framework 550 is immediately adjacent the casting ramp 584. Once the castings 110 are positioned on the platform 582 and the gripper arms 566, 568 are retracted therefrom, then the hydraulic cylinder 586 extends the piston rod 588 to raise one end of the platform 582, thereby causing the castings 110 to roll from the platform 582 onto the ramp 584 for additional processing. After the castings have rolled off the platform 582, the hydraulic cylinder 586 retracts the rod 588 thereby lowering the platform 582 back to the operating position.

The ramp 584 leads the castings to a weighing station 596 (FIG. 1). At this station, each of the castings are weighed and that information is transmitted back to the controller 42 through a conventional control line. The controller 42 compares the weight of the resulting casting 110 with the amount of the molten metal which is poured into the mold assembly 18 at the pouring station 30. If the weight of the casting 110 is outside a prescribed acceptable range, then the controller 42 will alter the weight of molten metal supplied to the mold assemblies at the pouring station 30. The weight of the resulting casting is often a critical element in proper quality control of the casting process. Therefore, direct feedback and control of the resulting casting weight provides a significant advantage over the prior art manual systems.

Once the casting 110 has been removed from the mold jacket 80, the mold jacket 80 and mold insert 82 must be prepared for additional casting operations. The next step in the processing table are the first and second temperature control stations 68, 70 (FIG. 1). These two stations are utilized to either heat or cool the mold insert 82 and jacket 80 to bring these elements of the mold assembly to a proper temperature for the future processing and casting steps. If it is necessary to heat the mold insert 82 and jacket 80 at the first and second temperature control stations 68, 70 such that these elements are at a desired temperature once they reach the pouring station 30, then heat can be directed at the elements for a prescribed period of time to reach a prescribed pouring temperature. The temperature to which these elements must be heated can be calculated by establishing the required temperature of the mold assembly at pouring, and then determining the rate at which the elements will cool during the additional processing steps. Alternatively, the jacket and insert can be cooled depending upon the desired temperature by directing a stream of air at the elements.

Figure 16:
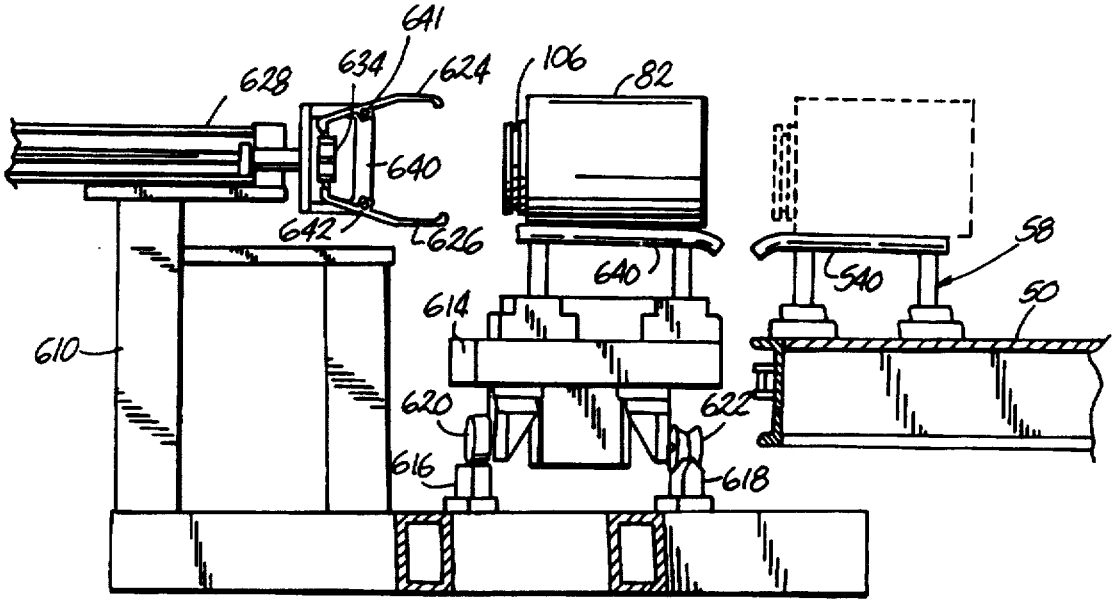
FIG. 16 is a side elevational view of the transfer car assembly of the mold reassembly station of FIG. 1.

The next station of the processing table is the mold reassembly station 71. As seen in FIGS. 16 and 17, the mold reassembly station 71 comprises a support framework 610 which supports the apparatus necessary to remount the mold insert 82 into the mold jacket 80. The first step in reassembling the mold assembly 18 is to remove the mold insert 82 from the turntable 50 for replacement in the corresponding mold jacket 80. As seen in FIG. 16, the mold insert 82 is slid from the mold insert support module 58 onto a transfer cart 612 for repositioning. The transfer cart 612 is identical to the cart of the insert removal station 64. The transfer cart 612 comprises a support platform 614 which is rollably supported by a flat guide rail 616, a peaked guide rail 618 and complementary wheels 620, 622. The transfer cart 612 is actuated for movement along the rails between a receiving position as seen in FIG. 16 and a discharge position as seen in FIG. 17 by a hydraulic cylinder (not shown), identical to the cylinder described in FIG. 11. Therefore, this will not be shown or described in detail.

The mold insert 82 is removed from the turntable 50 by a pair of gripper arms 624, 626 which selectively grasp the mold insert 82. A hydraulic cylinder 628 is mounted to the support framework 610 and the terminal end of the piston rod 630 is mounted to a support plate 632. A pair of guide rods (not shown) extend rearwardly from the support plate 632 to provide additional support and guidance for the plate through the extension and retraction movement of the cylinder 628.

A mounting bracket 640 is secured to the support plate 632. The opposed gripper arms 624, 626 are pivotally mounted by pivot pins 641, 642 to the mounting bracket 640. The opposed gripper arms 624, 626 are actuated between a gripping position and a release position by an actuator 634 provided on the mounting bracket 640 intermediate the ends of the gripper arms 624, 626.

The hydraulic cylinder 628 extends the support plate 632 and grippers arms 624, 626 forwardly until the distal ends of the gripper arms 624, 626 are spaced radially outwardly from the locking channel 106 of the mold insert 82. Then, the actuator 64 causes the gripper arms 624, 626 to actuate from the release position to the gripping position such that the distal ends of the arms are received in the locking channel 106. Once the gripper arms 624, 626 grip the mold insert 82, the hydraulic cylinder retracts the piston rod 630 while the gripper arms grasp the mold insert 82. Therefore, the mold insert 82 is slid from the mold insert support module 58 onto the support rails 640 of the transfer cart 612. After the mold inserts 82 are properly positioned on the transfer cart 612, then the gripper arms 624, 626 are retracted from the locking channel 106 and the gripper arm assembly is retracted away from the insert 82. Once the gripper arm assembly is clear of the insert 82, the hydraulic cylinder (not shown) controlling the transfer cart moves the transfer cart 612 from the receiving position as seen in FIG. 16 to the discharge position as seen in FIG. 17.

The first step of preparing the mold jacket 80 for receiving the mold insert 82 is to pivot the flyweights 92 out of interfering engagement with the insert 82. As seen in FIG. 17, this is accomplished by a circular guide member 644 which is supported at the base of a support bracket 646 which in turn extends downwardly from a pair of guide bushings 648. The bushings 648 are slidably mounted on a pair of guide rods 649 which are mounted to the support framework 610. A hydraulic cylinder 650 is similarly mounted to the support framework 610 and the terminal end of the piston rod is mounted to the support bracket 646. Extension and retraction of the piston rod from the cylinder 650 results in movement of the circular guide member 644 around the end of the mold jacket 80. Preferably, the guide member 644 is circular in cross section and the diameter is slightly larger than the circular diameter defined by the terminal ends of the mounting flanges 100 (FIG. 2) of the mold jacket 80. Therefore, as the guide member 644 is received on the end of the jacket 80, the guide member 644 contacts the weighted portions 96 of the flyweights and pivots the flyweights 92 about the pivot pins 98 thereby bringing the gripping portion 94 out of potentially interfering engagement with the reinsertion of the mold insert 82. After the circular guide member 644 has been properly positioned, the piston rod 652 of a hydraulic cylinder 654 suspended to the rear of the mold jacket 80 extend such that a stop plate 656 contacts the rear of the mold jacket 80. The hydraulic pressure is maintained in the hydraulic cylinder 654 during the mold reinsertion process to prevent the mold jacket 80 from moving rearwardly during the mold reinsertion process.

Once the circular guide member 644 and stop plate 656 are positioned, then the mold jacket 80 is ready for reinsertion of the mold insert 82. A hydraulic cylinder 658 is mounted to the support framework a mounting plate 674 is mounted to the terminal end of the piston rod 662. A pair of insert mounting heads 660 are mounted to the mounting plate 674. Preferably, the mounting heads 660 are formed from a soft, elastomeric material having sufficient strength and rigidity to support the mold insert 82 and yet soft enough not to damage the interior surface of the mold insert 82. Each mounting head 660 also has a central aperture 664 formed therein. Each central aperture 664 is interconnected to a source of pressurized air through a pair of air conduits 668, 670 and a valve 672 mounted intermediate the conduits.

As the piston rod 662 is extended from the hydraulic cylinder 658, the mounting head 660 is received inside the hollow interior of the mold insert 82. Eventually, the mounting plate 674 contacts the boss 104 and slides the insert 82 from the transfer cart 612 through the circular guide member 644 into the mold jacket 80. Just as the leading edge of the mold insert 82 nears the mold insert aperture 86 (FIG. 2) of the mold jacket 80, the valve 672 discharges a measured shot of pressurized air through the conduits 668, 670 to the central aperture 664 of the mounting head 660. The pressurized air will simultaneously blast the dirt and debris from the interior of the mold insert 82 and the interior of the mold jacket 80. Dirt and debris contained inside the mold jacket 80 could prevent proper mounting of the mold insert 82 therein.

Once the mold insert 82 is properly received inside the mold jacket 80, the hydraulic cylinders 658, 650, and 654 retract the corresponding piston rods thereby removing the mounting head 660, circular guide member 644 and stop plate 656 from the mold assembly 18 such that the casting table can index the reassembled mold assembly 18 to the next operating station.

Next, the processing table 16 indexes to locate the mold assemblies 18 at an interim station 72. In the preferred embodiment, no processing is conducted on the mold assemblies at this particular station. However, this open station provides flexibility for the addition of additional processing equipment depending upon the requirements of the system.

Next, the casting table 16 indexes the mold assemblies to a second mold cleaning station 74 (FIG. 1). The structure of the second mold cleaning station is identical to that of the first mold cleaning station 62 as seen in FIG. 10. Therefore, this structure will not be specifically described herein. In the preferred embodiment, the second mold cleaning station 74 differs from the first 62 in that the brush is adapted to contact the interior, molding surface of the mold insert 82 and jacket 80. As the brush rotates, a vacuum air flow is provided to the end of the mold assembly 18 through the exhaust hood.

Finally, the processing table 16 indexes again to locate the mold assemblies 18 at the pick-up station 76. As seen in FIG. 1, the pick-up station 76 is immediately adjacent the receiving station 22 of the casting table and the second transfer mechanism 212. As described above, the structure of the first transfer mechanism 210 is identical to that of the second transfer mechanism 212 and therefore the structure will not be specifically described herein. The operation of the second transfer mechanism is merely the reverse of that of the second transfer mechanism. Namely, the second transfer mechanism lifts, rotates and conveys the mold assemblies 18 from the processing table 16 and returns them to the casting table 14 for additional casting operations.

Once the mold assembly 18 has been returned to the casting table 14, the casting table indexes to the acceleration station 24. As described above, the spin module 20 begins rotation of the mold assemblies 18 at this station.

Figure 5:
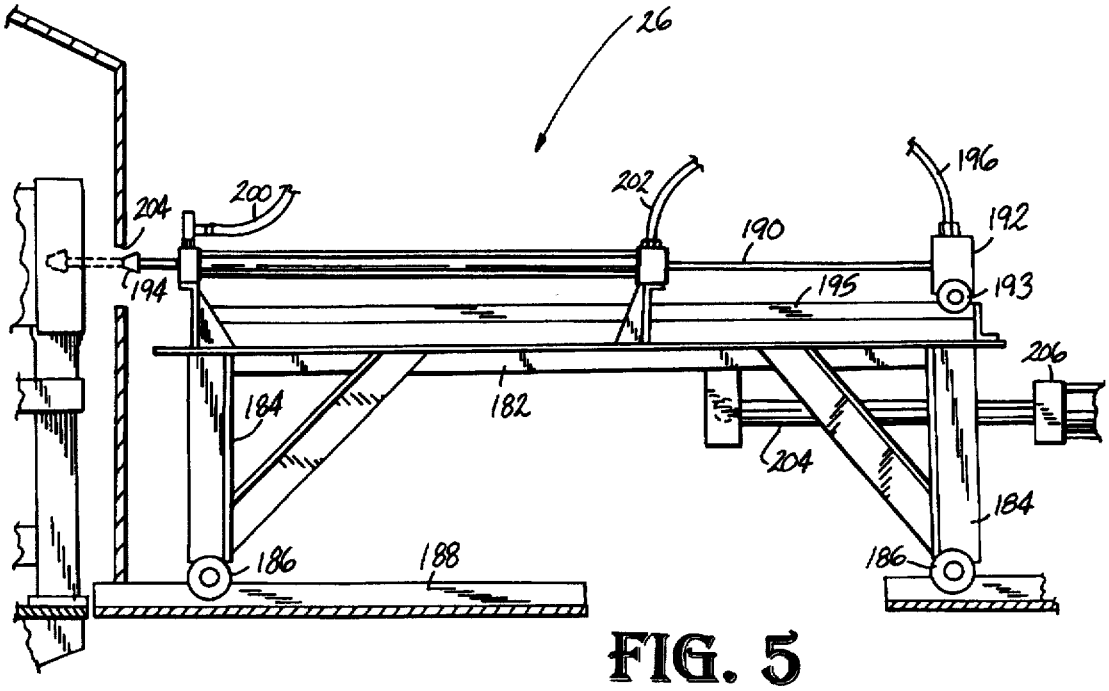
FIG. 5 is a side elevational view of a mold release agent station of the casting table of FIG. 1.

The next station of the casting table 14 is the mold release agent station 26. As described above, a suitable liquid, mold release agent is sprayed onto the interior surfaces of the mold insert 82 and jacket 80. As seen in FIG. 5, the mold release agent station 26 comprises a support platform 182 having a plurality of downwardly extending legs 184 and wheels 186 mounted at the bottom of the legs 184. The wheels 186 are supported by guide rails 188. The wheels 186 and guide rails 188 cooperate for adjusting the position of the support platform 182 relative to the casting table 14.

A spray rod 190 is mounted to the top of the support platform 182 and is supported at one end by a support block 192 and has a spray nozzle 194 mounted to the other end thereof. A pair of wheels 193 are mounted to the base of the support block and are, in turn, supported by guide rails 195 extending the length of the platform 182. The spray rod 190 has a longitudinal aperture extending therethrough such that pressurized fluid or mold release agent supplied to the support block 192 through an appropriate fluid supply line 196 is discharged from the spray rod 190 through the spray nozzle 194.

The spray rod 190 is articulated for movement between a retracted position as seen in FIG. 5 and an extended position wherein the spray rod 190 and spray nozzle 194 are fully inserted into the mold assembly 18 through the molten metal aperture 84 of the mold jacket 80. Movement of the spray rod 190 between these two positions is controlled by a hydraulic cylinder 198 through which the spray rod 190 extends. Pressurized fluid is supplied to the hydraulic cylinder 198 from the hydraulic fluid source 44 (FIG 1) to extend and retract the rod 190 with respect to the mold assembly 18. During insertion into the mold assembly, the spray rod 190 and spray nozzle 194 pass through a rod aperture 204 formed in the hood 48. The timing, duration and volume of fluid supplied to the hollow interior of the mold by the spray rod 190 is dictated by the controller 42 which controls the supply of mold release agent to the spray rod 190 through the fluid supply line 196.

Movement of the support platform 192 along the guide rails 188 is controlled by the extension and retraction of a piston rod 204 from a hydraulic cylinder 206. The distal end of the piston rod 204 is mounted to the support platform 182 and the hydraulic cylinder 206 is mounted to the floor a spaced distance radially outwardly from the casting table 14. Extension and retraction of the piston rod 204 from the hydraulic cylinder 206 results in movement of the support platform 182 along the guide rails 188.

After the mold assembly 18 has been sufficiently coated with a mold release agent, the casting table 14 indexes to the spin-drying station 28. As noted above, the mold assemblies 18 are rotated at this station a sufficient time for any solvent of the mold release agent to be evaporated, leaving only a dry coating on the hollow interior of the mold assemblies 18. Finally, the casting table 14 indexes to return the mold assemblies 18 to the pouring station for production of an additional pair of castings. From this point, the process repeats itself.

The automatic casting system 12 according to the invention is ideally suited for the mass production of spin-castings in that the rotary casting table 14 and processing table 16 can accommodate a large number of mold assemblies for simultaneous casting and processing. In a preferred embodiment, a total of forty mold assemblies 18 are supported on the casting and processing tables for the continuous production of the castings. The matched mold inserts and mold jackets remain paired with one another to increase the quality control of the resulting product.

Reasonable variation and modification are possible within the spirit of the foregoing specification and drawings without departing from the scope of the invention.

The embodiments for which an exclusive property or privilege is claimed are defined as follows:

1. A system for the automated production of castings in a plurality of mold assemblies comprising:

a casting subsystem comprising:

a casting table adapted to rotate about an axis of rotation and having a top surface and at least one mold assembly support module provided on the top surface thereof, the at least one mold assembly support module being adapted for supporting at least one mold assembly; and a pouring apparatus provided adjacent the casting table and adapted to provide molten casting material to the mold assembly supported by the module;

a processing subsystem comprising:

a processing table adapted to rotate about an axis of rotation, having a top surface and at least one mold assembly support module mounted to the top surface thereof, the mold assembly support module being adapted to support at least one mold assembly; and a casting removal apparatus provided adjacent the processing table and adapted to remove a casting from the at least one mold assembly supported by the at least one mold assembly support module of the processing table; and a transfer mechanism adapted to transfer at least one mold assembly from the casting table to the processing table.

2. A system according to claim 1 wherein the at least one mold assembly support module of the casting table comprises at least one spin module mounted to the top surface of the casting table, the spin module being adapted to rotatively support the at least one mold assembly on the casting table.

3. A system according to claim 2 wherein the at least one spin module comprises a variable speed motor adapted to rotate the at least one mold assembly.

4. A system according to claim 1 wherein the casting subsystem further comprises a mold release agent spraying apparatus mounted adjacent the periphery of the casting table and adapted to provide a mold release agent to the mold assembly.

5. A system according to claim 1 wherein the casting subsystem further comprises a quenching apparatus mounted adjacent the periphery of the casting table and adapted to provide a quenching agent to the mold assembly.

6. A system according to claim 1 and further comprising a hydrostatic motor mounted to the casting turntable for rotating the casting turntable and the at least one mold assembly support modules mounted thereon.

7. A system according to claim 1 wherein the processing subsystem further comprises at least one mold cleaning station mounted adjacent the periphery of the processing table and adapted to clean at least a portion of the mold assembly.

8. A system according to claim 1 wherein the mold assembly comprises a first mold member and a second mold member and the processing subsystem further comprises a mold disassembly apparatus mounted adjacent the periphery of the processing table adapted to separate the first and second mold members from one another.

9. A system according to claim 8 wherein the processing subsystem further comprises a mold reassembly apparatus mounted adjacent the periphery of the processing table adapted to reassemble the first and second mold members.

10. A system according to claim 1 wherein the processing subsystem further comprises a temperature control apparatus mounted adjacent the periphery of the processing table and adapted to heat or cool at least one of the first and second mold members to a desired temperature.

11. A system according to claim 1 wherein the transfer mechanism comprises:

a first support member provided adjacent the casting and processing tables adapted to traverse the space separating the casting and processing tables;

a second support member supported by the first support member adapted to rotate relative to the first support member, casting table and processing table; and a third support member supported by the second support member adapted to raise and lower the at least one mold assembly relative to the processing and casting tables.

12. A system for processing castings formed in a plurality of mold assemblies wherein the plurality of mold assemblies comprise a first mold member and a second mold member, the system comprising:

a processing table adapted to rotate about an axis of rotation and having a top surface, a periphery and at least one mold assembly support member provided on the top surface;

a mold cleaning station mounted adjacent the periphery of the processing table adapted to clean at least a portion of the mold assembly;

a casting removal apparatus provided adjacent the periphery of the processing table and adapted to remove a casting from the at least one mold assembly; and a mold disassembly apparatus mounted adjacent the periphery of the processing table adapted to separate the first and second mold assemblies from one another.

13. A system for processing castings according to claim 12 and further comprising a mold reassembly apparatus mounted adjacent the periphery of the processing table adapted to reassemble the first and second mold members.

14. A method for the automated production of castings comprising the steps of:

providing a casting table rotatively provided on a supporting surface and at least one mold assembly support module provided on the casting table;

providing a processing table rotatively provided on a supporting surface and at least one mold assembly support module provided on the processing table;

providing at least one mold assembly having a mold cavity formed therein;

providing a pouring apparatus adjacent the casting table and adapted to supply molten casting material to the mold cavity of the at least one mold assembly;

providing a casting removal apparatus adjacent the processing table and adapted to remove the casting from the mold cavity;

pouring molten casting material into the mold cavity of the at least one mold assembly;

rotating the casting table;

transferring the mold assembly to the processing table;

removing the casting from the mold assembly; and rotating the processing table.

15. A method according to claim 14 and further comprising the step of transferring the at least one mold assembly from the processing table to the casting table after the casting has been removed from the mold assembly.

16. A method according to claim 15 and further comprising the steps of lifting, rotating and conveying the mold assembly while transferring the mold assembly from processing table to the casting table.

17. A method according to claim 14 and further comprising the step of rotating the mold assembly during the step of pouring molten casting material into the mold cavity.

18. A method according to claim 17 and further comprising the step of providing a mold release agent in the mold cavity prior to the step of pouring molten casting material into the mold cavity.

19. A method according to claim 18 and further comprising the steps of rotating the mold assembly and spraying the mold release agent into the mold cavity as the mold assembly is rotated.

20. A method according to claim 14 and further comprising the step of rotating the mold assembly after the molten casting material has been poured into the mold cavity for a period of time sufficient for solidification of the molten casting material.

21. A method according to claim 14 and further comprising the step of quenching the mold assembly during cooling of the casting inside the mold cavity.

22. A method according to claim 21 and further comprising the step of rotating the mold assembly as the casting is being quenched.

23. A method according to claim 14 and further comprising the steps of lifting, rotating and conveying the mold assembly while transferring the mold assembly from the casting table to the processing table.

24. A method according to claim 14 and further comprising the step of cleaning at least a portion of the mold assembly prior to removing the casting from the mold assembly.

25. A method according to claim 14 and further comprising the step of controlling the temperature of the mold assembly after removal of the casting so that the mold assembly has acquired a temperature within a prescribed range for the production of additional castings.

* * * * *